US006783817B2

(12) United States Patent
Nemoto et al.

(10) Patent No.: US 6,783,817 B2
(45) Date of Patent: Aug. 31, 2004

(54) INK JET RECORDING SHEET

(75) Inventors: Hiroyuki Nemoto, Ichihara (JP); Koichi Yasui, Nishinomiya (JP); Shunichiro Mukoyoshi, Urayasu (JP)

(73) Assignee: OJI Paper Co., Ltd., Tokyo (JP)

( * ) Notice: Subject to any disclaimer, the term of this patent is extended or adjusted under 35 U.S.C. 154(b) by 0 days.

(21) Appl. No.: 10/299,760

(22) Filed: Nov. 20, 2002

(65) Prior Publication Data

US 2003/0211293 A1 Nov. 13, 2003

Related U.S. Application Data

(62) Division of application No. 09/694,371, filed on Oct. 24, 2000, now abandoned.

(30) Foreign Application Priority Data

Oct. 25, 1999 (JP) ..... 11-301916
Dec. 27, 1999 (JP) ..... 11-370594
Sep. 29, 2000 (JP) ..... 2000-300516

(51) Int. Cl.[7] ..... B41M 5/00

(52) U.S. Cl. ..... 428/32.24; 428/32.18; 428/32.19; 428/32.27; 428/32.28; 428/32.31; 428/32.33; 428/32.38

(58) Field of Search ..... 428/32.18, 32.19, 428/32.24, 32.27, 32.28, 32.31, 32.33, 32.38

(56) References Cited

U.S. PATENT DOCUMENTS 6,165,606 A 12/2000 Kasahara et al.
6,217,166 B1 4/2001 Saito et al.

FOREIGN PATENT DOCUMENTS

| | | | |
|---|---|---|---|
| EP | 0 298 424 | A2 | 1/1989 |
| EP | 507 409 | A1 | 10/1992 |
| EP | 0 516 370 | A1 | 12/1992 |
| EP | 0 947 350 | A1 | 10/1999 |
| JP | 60046289 | A | 3/1985 |
| JP | 61237682 | A | 10/1986 |
| JP | 62134287 | A | 6/1987 |
| JP | 62152779 | A | 7/1987 |
| JP | 4-216990 | | 8/1992 |
| JP | 5-96843 | | 4/1993 |
| JP | 05286228 | A | 11/1993 |
| JP | 06171206 | A | 6/1994 |
| JP | 6-171207 | | 6/1994 |
| JP | 07032723 | A | 2/1995 |
| JP | 08269900 | A | 10/1996 |
| JP | 09001924 | A | 1/1997 |

*Primary Examiner*—Pamela R. Schwartz
(74) *Attorney, Agent, or Firm*—Arent Fox PLLC

(57) ABSTRACT

In an ink jet recording sheet including a substrate sheet having a base paper sheet and at least a front polyolefin laminate layer formed on at least a front surface of the base paper sheet, and an ink receiving layer formed on the front polyolefin laminate layer, the surface of the front polyolefin laminate layer has a center-line mean roughness (Ra) of 0.1 to 10 $\mu$m, determined in accordance with JIS B 0601-1982, the ink receiving layer contains a mixture of hydroxypropylmethyl cellulose with polyvinyl pyrrolidone in a mixing weight ratio of 100:10 to 100:150 and has a 75° specular gloss of 30% or more determined in accordance with JIS P 8142-1993.

15 Claims, No Drawings

INK JET RECORDING SHEET

This is a Division of application Ser. No. 09/694,371 filed Oct. 24, 2000 now abandoned. The disclosure of the prior application is hereby incorporated by reference herein in its entirety.

BACKGROUND OF THE INVENTION

1. Field of the Invention

The present invention relates to an ink jet recording sheet. More particularly the present invention relates to an ink jet recording sheet having an ink receiving layer coated on a substrate with high adhesion, having a recording surface with a high gloss and capable of recording thereon ink images having a high clarity with a high ink drying property.

2. Description of the Related Art

In an ink jet recording system, desired ink images are recorded on a recording sheet by jetting imagewise fine drops of an ink from an ink jetting nozzle toward a recording surface of the recording sheet to cause the jetted ink drops to be absorbed imagewise in the recording sheet. Printers using the ink jet recording system are appropriately utilized for color printing and are advantageous in that the sizes of the printers are small and the prices of the printers are lower than that of printers using other recording systems.

Currently, since the performances of personal computers have significantly improved and multimedia functions have become widespread, a demand for printing documents including colored images or colored photographs in office or home has been promoted. For this demand, color printer using the ink jet recording system are considered to be very useful output printers.

As a conventional recording sheet usable for the ink jet recording system, a recording sheet produced by coating a surface of a substrate paper sheet with an ink-absorbing resin, or a mixture of a pigment selected from various types of pigments with a water-soluble resin or latex resin, to form an ink receiving layer, and optionally smoothing the surface of the ink receiving layer by, for example, a supercalender treatment, is employed. The conventional recording sheet is, however, disadvantageous in that since the surface of substrate paper sheet is rough due to the pulp fibers located in the surface portion of the sheet, and has an unsatisfactory smoothness, the resultant recording sheet exhibits an insufficient gloss. Also, when the conventional recording sheet is subjected to an ink jet recording procedure, the ink-absorbed portions of the printed sheet expand and thus the printed sheet is roughened and wavy.

In view of the poor performance of the substrate paper sheet, a polyolefin-coated sheet in which both the surfaces of a base paper sheet are coated with a polyolefin resin, for example, as polyethylene resin, or a plastic resin film, for example, a polyester film is employed in place of the paper sheet, as a substrate sheet for the ink jet recording sheet. As reported in Japanese Unexamined Patent Publications No. 4-216,990 and No. 7-32,723, when this type of the substrate sheet is coated with an ink receiving layer, the resultant ink jet recording sheet is evaluated at a certain high level.

Namely, the polyolefin-laminated substrate sheet or the plastic resin film has a high smoothness and thus the resultant ink jet recording sheet exhibits a high gloss.

However, since the polyolefin-laminating layer or the polyester resin film are hydrophobic, generally, the resultant hydrophobic substrate sheet has a surface having a poor affinity to the ink receiving layer and thus when an aqueous coating liquid for the ink receiving layer is applied onto the hydrophobic surface of the substrate sheet, a repelling phenomenon, for the coating liquid, occurs on the substrate sheet surface to form coating defects in the resultant ink receiving layer, or the resultant ink receiving layer exhibits a poor adhesion to the substrate sheet.

To prevent the above-mentioned disadvantages, before the coating of the substrate sheet with the coating liquid for the ink receiving layer, a surface-activating treatment, for example, a corona discharge treatment, is applied to the substrate sheet surface, and an undercoat layer comprising a water-soluble resin, as a principle component, is formed on the substrate sheet. These pre-treatments are not satisfactory for the ink jet recording sheet for practical use.

Accordingly, there is a strong demand for an ink jet recording sheet in which an ink receiving layer'is firmly bonded to a substrate consisting of a polyolefin-laminated paper sheet with a high adhesion.

When the polyolefin-laminated paper sheet is employed as a substrate sheet for an ink jet recording sheet, there is another disadvantage in that a curling phenomenon occurs.

Generally, the ink jet recording sheet for practical use must have a good appearance and must pass easily through a printer. To satisfy these requirements, the recording sheet preferably has a certain curling property. In the usual use environment, the recording sheet must be flat or be slightly curled in a convex shape. This form is referred to as a back-curling form. After printing, when the printed sheet is observed, if the front surface, namely, the ink receiving layer surface is curled in the form of a concave, which form is referred to as a top-curling form, observation is difficult and the appearance of the curled sheet is bad. Also, when the curled sheet in the top-curling form is attached at the back surface thereof on a wall surface, the edge portions of the sheet are spaced from the wall surface and cannot be stably attached to the wall surface. Also, when the ink jet recording sheets having a top-curling property are subjected to a printing procedure, the sheets cannot travel through the printer and cannot be accurately printed. Thus, the recording sheet must be in a flat form or in a slightly convexed form which form is referred to as a slightly.

The ink receiving layer usually expands or shrinks due to the change in temperature and humidity of the environment. Thus, even when a recording sheet exhibits a desired curling property under a specific environmental conditions, it may exhibit a high top-curling property under a low temperature low humidity condition, or a high back-curling property under a high temperature high humidity condition. These properties may cause the recording sheets to be difficult to use in practice.

The curling property can be reduced to a certain extent by increasing the thickness and the rigidity of the sheet. However, the thick recording sheets have a bad appearance and a high price and thus are not suitable for practical use.

Various attempts were made to obtain a desired curling properties. However, a desired ink jet recording sheet having both the high gloss and the desired curling property has not yet been obtained.

Japanese Unexamined Patent Publication No. 8-269,900 discloses a support for image-carrying material, which comprises a base sheet made from a paper sheet comprising as a principal component, a natural pulp, a film-forming resin layer covering a surface of the base sheet on which surface an image-forming layer is formed, and a polyolefin coating layer covering the opposite surface of the base sheet. The support is wound in the form of a roll. In this roll, the support is wound in such a manner that the image-forming layer becomes outside surface layer and the resultant roll is stored at a temperature of 20° C. or more. However, in this support, only the curling property is fixed by storing the polyolefin resin-coated sheet substrate at a specific temperature. Thus, even if a desired curling property is obtained in specific circumstances, when the circumstances change, it is difficult to restrict the resultant curling phenomenon.

Japanese Unexamined Patent Publication No. 6-171,206 discloses an ink jet recording sheet comprising a support with at least one type of ink receiving layer formed on a front surface of the surface and at least one back-coat layer formed on a back surface of the support. The recording sheet is characterized in that the backcoat layer comprises a pigment and a binder, as principal components, and the pigment has an average equilibrium moisture content of 1.9 to 5.5%. In this recording sheet, the support is formed from a paper sheet made from, as principal component materials, a wood pulp such as a chemical pulp, mechanical pulp or waste paper pulp and a conventional pigment, or a coated paper sheet comprising a paper sheet and polyolefin resin layers covering the paper sheet, or a film. The back-coat layer comprises a pigment of, for example, precipitated calcium carbonate, ground calcium carbonate, kaolin, and talc, and a binder, for example, polyvinyl alcohol, polyvinyl acetate, oxidized starch etherified starch, and cellulose derivatives, for example, carboxymethyl cellulose, and hydroxyethylcellulose. The backcoat layer comprising the pigment and the binder as principal components, is, however, disadvantageous in that the curling-restricting effect thereof is low. Thus, to obtain a satisfactory curling-restricting effect, the coating layer must be formed to a very large thickness.

Japanese Unexamined Patent Publication No. 6-171,207 discloses an ink jet recording sheet having a support comprising mainly a wood pulp and a pigment, at least one ink receiving layer formed on a front surface of the support, and at least one backcoat layer formed on the back surface of the support, and characterized in that a binder for the backcoat layer comprises a synthetic polymer latex having a glass transition temperature of −50° C. to +25° C., as an indispensable component, and a water-soluble binder comprising at least one member selected from starch, polyvinyl alcohol and cellulose derivatives. The support is made from a paper sheet produced from a wood pulp such as chemical pulp, mechanical pulp and waste paper pulp and a conventional pigment, as principal components. This type of the ink jet recording sheet is, however, disadvantageous in that the curl-restricting property is insufficient, and a high gloss appropriate for full colored ink images cannot be obtained because the paper sheet support has a rough surface and, when the ink is absorbed, the ink jet recording sheet surface is roughened by the absorbed ink.

Japanese Unexamined Patent Publication No. 5-286,228 discloses a recording sheet having a coloring matter-absorbing layer formed on a support material, wherein a polymer layer having a high water-swelling property is formed on a surface of the support material opposite to the surface on which the coloring matter-absorbing layer is formed. The support material is formed from sheets of plastic resins, for example polyester resins such as polyethylene terephthalate resin and polyester diacetate, and fluorine-containing resins such as ETFF. Also, the materials for the high swelling polymer layer is selected from, for example, polyvinyl alcohol, polyvinyl pyrrolidone and mixtures thereof. However, since the polyvinyl alcohol or polyvinylpyrrolidone absorb moisture and exhibit a tackiness, the resultant ink jet recording sheets may cause a blocking phenomenon in the printer.

Japanese Unexamined Patent Publication No. 5-96,843 discloses a recording sheet comprising an ink receiving layer, a base sheet, a heat-absorbing layer and an anti-curling layer. The base sheet is selected from transparent films of polymeric materials, for example, polyesters, polycarbonates, polysulfones, cellulose triacetate, polyvinyl chloride, viscose rayon (cellophane: trademark), and polyvinyl fluoride; flat paper sheet, for example, diazo paper sheet, opaque polymeric films and filler-filled polymer sheets. The heat-absorbing layer is formed from, for example, a vinylidene fluoride-hexafluoropropylene-copolymer, a vinylidene fluoride-hexafluoropropylene-tetrafluoroethylene copolymer or a vinylidene-tetrafluoroethylene-propylene copolymer. The anti-curling layer is formed from, for example, hydroxyporpylmethlcellulose, hydroxybutylmethylcellulose, hydroxyethylmethylcellulose, hydroxyethylcellulose, hydroxymethylcellulose, a carboxymethylcellulose salt and a caboxymethylhydroxyethylcellulose salt or methylcellulose.

However, the materials for the heat-absorbing layer are selected without consideration of the close adhesion between the polyolefin resin-coated back surface of the substrate sheet and the backcoat layer. Further, in a high humidity environment, the recording sheet exhibits an insufficient resistance to curling.

Generally, for the ink jet recording system, an aqueous ink is used in consideration of the high quality of the recorded images and of the high safety. The aqueous ink comprises a coloring material, for example, a dye or a coloring pigment, a polyhydric alcohol for preventing blocking of ink-jetting nozzles and another additive, dissolved or dispersed in a water medium.

The recording sheet for the ink jet recording system includes conventional wood-free paper sheets and specific ink jet recording sheets, for example, ink jet recording paper sheets having an ink receiving layer formed on a substrate paper sheet; gloss ink jet recording sheets having a gloss layer formed on the ink receiving layer; OHP ink jet recording sheets having an ink receiving layer formed on a transparent polyester film substrate; gloss ink jet recording sheets having an ink receiving layer formed on a white-colored polyester film substrate; synthetic paper ink jet recording sheets having an ink receiving layer formed on a synthetic paper substrate, photographic sheet-like ink jet recording sheets having a substrate comprising polyethylene resin-laminating layers formed on a paper sheet substrate and a ink receiving layer on the polyethylene resin-laminating layer of the substrate.

Currently, an ink jet printer or ink jet plotter which can record thereon high accuracy ink images similar to silver salt photographic images at high speed is developed and is available at a low price. For example, the ink jet recording system is included in digital cameras and scanners for the office or the home and is used for outputting the images and is used for business uses, for example, electric decoration signboards and a production of trade samples, for printing uses, for example, a production of printing plate material, for design uses, for example, printing of design images, for example, various colored images. For these uses, the ink jet recording sheet capable of recording thereon silver salt photographic image-like ink images having a surface gloss and an appearance similar to those of the silver salt photographic images, is in demand. The photograph support-like ink jet recording sheet is usually prepared by forming an ink receiving layer on a resin-coated paper sheet made by coating both the front and back surfaces of a substrate paper sheet with a polyethylene resin composition. The resin-coated paper sheet having polyethylene resin coating layers formed on the two surfaces of the substrate paper sheet does not allow an ink to permeate into the sheet because the polyethylene resin is hydrophobic, and is free from a cockling phenomenon which is generated when a paper sheet absorbs ink drops, has a high flatness, a low roughness and a high smoothness in comparison with these of the pulp paper sheets, for example, a wood-free paper sheet. Therefore, the resin-coated paper sheet is advantageously employed to produce an ink jet recording sheet having a high gloss and capable of recording thereon accurate ink images and the resultant ink jet recording sheet exhibits a silver salt photographic printing sheet-like hand.

The photographic printing sheet-like ink jet recording sheets are classified into two groups. The first group of recording sheets have an ink receiving layer comprising a resin composition containing, as a principal component, a resin having a capability of absorbing the ink usable for the ink jet recording. Thus, immediate after the printing, the ink receiving layer is swollen by the absorbed ink. The second group of recording sheets has an ink receiving layer comprising a pigment-binder composition comprising, as a principal component, a pigment capable of absorbing the ink used for the ink jet recording. In this case, immediate after the printing, the ink is absorbed in the internal pores formed in the particles of the pigment and in the gaps formed between the pigment particles each other. The former type of ink jet recording sheet is referred to as a swelling type recording sheet, and latter type of ink jet recording sheet is referred to as a space-absorbing type recording sheet.

The swelling type ink jet recording sheets are generally advantageous in that a high gloss can be relatively easily obtained and the production cost is low, but disadvantageous in that the water resistance of the recording sheets is low. Compared with this, the space-absorbing type ink jet recording sheets are advantageous in the high water resistance thereof but are disadvantageous in that a high gloss is difficult to obtain, and/or, specific materials are necessary for forming the ink receiving layer, and the production cost is high.

In the present invention, a swelling type ink receiving layer is advantageously utilized.

The swelling type ink receiving layer contains, as a principal component resin capable of absorbing the ink usable for the ink jet recording, at least one member selected from, for example, polyvinyl pyrrolidone, polyvinyl alcohol, polyvinyl acetal, carboxymethylcellulose, hyudroxyethylcellulose, hydroxypropylmethylcellulose, polyethylene glycol, polyethyleneoxide, starch, casein and gelatin, and optionally, a cationic ink-fixing agent for fixing the absorbed ink, a pigment filler for preventing a blocking phenomenon, a surfactant, a fluorescent brightening agent and/or a viscosity-modifier is contained in the ink receiving layer.

The ink receiving layer containing, as a principal component, the ink-absorbing resin, is usually hydrophilic and thus generally exhibits an insufficient adhesion to a substrate sheet in which a substrate paper sheet is coated with a hydrophobic, water-nonabsorbing polyolefin resin. To solve this problem, the surface of the polyolefin resin coating layer is surface-activated by, for example, a corona discharge treatment before coating the ink receiving layer, or the ink receiving layer is added with a material having a high affinity to the polyolefin resin. However, these conventional means are insufficient to enhance the adhesion of the ink receiving layer to the polyolefin resin coating layer to a high level. Even if the adhesion is enhanced, the above-mentioned conventional means may cause the ink-absorbing property of the ink receiving layer to be degraded, or the printed ink images may be blotted or the curl-preventing property may be degraded.

Also, even if, before printing is applied, the adhesion of the substrate sheet to the ink receiving layer is good, after printing, the ink-absorbed portions of the ink receiving layer exhibits a reduced adhesion to the substrate sheet and, thus, when a small force is applied to the printed sheet, scratching damage is formed on the ink receiving layer, or the ink receiving layer locally slippes on the substrate sheet and thus the appearance of the printed sheet is significantly degraded. The possibility of generation of the above-mentioned phenomenon increases with an increase in the content of a polyhydric alcohol having a high boiling temperature and a high resistance to vaporization in the ink applied to the ink receiving layer and/or with an increase in the amount of the ink applied to the ink receiving layer per unit area of the ink receiving layer.

In the ink jet recording sheet having, as a substrate sheet, a polyolefin resin-coated paper sheet or a plastic resin film, for example, a polyester resin film, which is hydrophobic and has no ink-absorbing capacity, the above-mentioned problem in adhesion of the substrate sheet to the ink receiving layer occurs. To solve this problem, various attempts have been made. Namely, an anchor layer may be arranged between the substrate sheet and the ink receiving layer. Alternatively, the ink receiving layer may be formed in a two or more layered structure.

Various types of anchor layers have been formed between the polyolefin resin coated substrate sheet and the ink receiving layer. For example, Japanese Unexamined Patent Publication No. 7-32,723 discloses an ink jet recording sheet having an ink receiving layer formed on a polyolefin resin-coated sheet having a specific rigidity. In an example disclosed in the publication, the polyolefin resin-coated sheet was subjected to a corona discharge treatment and, then, an intermediate layer comprising gelatin, a curing agent and a surfactant was coated in an amount of 0.1 $g/m^2$ on the corona discharge-treated surface, and an ink receiving layer comprising silica, colloidal silica, polyvinyl alcohol, a fixing agent, and a surfactant was coated in an amount of 10 $g/m^2$ on the intermediate layer. The ink jet recording sheet produced by the above-mentioned method is advantageous in that no cockling phenomenon occurs but is disadvantageous in that the ink receiving layer has a low gloss and is not appropriate to record colored images with a high accuracy.

Japanese Unexamined Patent Publication No. 60-46,289 discloses a recording sheet having a water-soluble polymer-coated layer formed on a water-nonabsorbing support, and an anchor coat layer formed between the support and the coated layer and comprising, as a principal component, a water-soluble copolyester resin. The water-soluble copolyester resin-containing anchor coat layer may be applied to the polyolefin resin-coating layer of the substrate sheet. In this case, even if the polyolefin resin-coating layer can be coated with the anchor coat layer with a high adhesion, the adhesion between the anchor coat layer and the ink receiving layer may be insufficient, or the applied ink may be accumulated in a boundary between the anchor coat layer and the ink receiving layer and the ink images may be blotted, or the ink receiving layer may locally slip on the polyolefin resin-coated substrate sheet due to a small external physical force. Namely, the above-mentioned ink jet recording sheet failed to solve the above-mentioned problems.

Japanese Unexamined Patent Publication No. 61-237,682 discloses an ink jet recording sheet having a hydrophobic material layer formed on an ink receiving layer. In this recording sheet, the ink receiving layer is formed in a two-layered structure. The first layer is formed from a hydrophilic polymer and coated with a second layer formed from a polymer having a hydrophilicity equal to or lower than that of the first layer. The first (under) layer has a high ink-holding property and the second (upper) layer serves as an ink-permeating layer through which the ink is allowed to rapidly pass or as a protecting layer for the under layer. To improve the mechanical strength of the ink receiving layer or the adhesion between the ink receiving layer and the substrate sheet, the ink receiving layer optionally contains an SBR latex, a NBR latex, polyvinylformal, polymethyl methacrylate, polyvinyl butyral, polyacrylonitrile, polyvinyl chloride, polyvinyl acetate, a phenol resin or an alkyl resin. However, when these polymers are employed together with the hydrophilic polymer, the resultant ink receiving layer is deteriorated in the ink-absorbing property, the ink drying property and the resistance to ink-blotting, while the adhesion of the ink receiving layer to the substrate sheet is improved.

Japanese Unexamined Patent Publication No. 62-134,287 discloses an ink jet recording sheet having a substrate material and an ink receiving layer formed on the substrate material. The ink receiving layer may have a single-layer structure or a two-layered structure having a first (under) layer formed from a hydrophilic polymer and a second (upper) layer formed from a polymer having a hydrophilicity equal to or lower than that of the first layer. As an anchor coat layer, a layer comprising a curable resin composition comprising a mixture of a reactive or cross-linkable polyester resin, polyamide resin, or acrylic resin with an appropriate cross-linking agent, or a polyhalogenated vinyl resin is disclosed. The anchor coat layer may contribute to enhancing the adhesion between the polyolefin resin-coating layer and the anchor coat layer. However, the anchor coat layer causes the ink receiving layer to exhibit a low adhesion to the anchor coat layer, or the applied ink is accumulated in the boundary between the anchor coat layer and the ink receiving layer and thus the printed ink images are blotted, or the ink receiving layer locally slips on the polyolefin resin coated substrate sheet due to a small external physical force applied to the ink receiving layer. Namely, the ink jet recording sheet fails to solve the above-mentioned problems.

Japanese Unexamined Patent Publication No. 62-152,779 discloses an ink jet recording sheet comprising two or more-layered coating layer formed on a substrate material, wherein an upper layer in the coating layer exhibits a higher ink-absorbing rate than that of an under layer in the coating layer. The ink jet recording layer comprises a water-soluble or hydrophilic polymeric material, for example, gelatin, casein, starch, a polyamide, a polyacrylamide, polyvinylpyrrolidone, polyvinyl alcohol or a cellulose derivative. When the ink-absorbing rate of the upper layer is controlled to be higher than that of the under layer, the resultant ink receiving layer exhibits an improved resistance to blotting of ink images. However, when the above-mentioned type of ink receiving layer is formed on the polyolefin resin-coated substrate material, the adhesion between the ink receiving layer and the substrate sheet may be insufficient, or when a solvent component contained in the ink jet recording ink has a low vaporizing property, the ink can fully penetrate into the ink receiving layer and thus, after a certain time has passed, the adhesion of the ink-absorbed portions of the ink receiving layer to the substrate sheet is degraded. Thus, the ink jet recording sheet fails to solve the above-mentioned problems.

Japanese Unexamined Patent Publication No. 9-1924 discloses an ink jet recording sheet having an ink receiving layer formed on a support, wherein the ink receiving layer is a two- or more-layered structure. With respect to the two or more component layers in the ink receiving layer of the recording sheet, the closer the location of a component layer to the support, the relatively higher the affinity of a polymer contained in the layer to a high boiling temperature solvent contained in the ink applied to the ink receiving layer, and the closer the location of a component layer to the outermost surface of the ink receiving layer, the relatively lower the affinity of a polymer contained in the component layer to the high boiling temperature solvent contained in the ink. However, when a polymer having a high affinity to the high boiling temperature solvent in the ink is contained in a component layer close to the support, after the printing is completed, a large portion of the absorbed ink is located in the location close to the support, and thus the applied ink images exhibits a low drying rate and thus the ink recording layer may locally slip on the polyolefin resin-coated substrate layer.

As mentioned above, when an ink receiving layer is formed on a substrate sheet formed from a polyolefin resin-coated paper sheet or a polyester film which is hydrophobic and exhibits no ink-absorbing property, various attempts have been made to improve the adhesion between the ink receiving layer and the substrate sheet. However, target ink jet recording sheets satisfactory in all of high gloss, high smoothness, high ink-absorbing property, high ink drying rate and high resistance to ink-blotting; capable of recording thereon ink images having a high color density, a high clarity and a high accuracy, and exhibiting a high adhesion between the substrate sheet and the ink receiving layer not only before the printing but also after the printing, have not yet been obtained.

SUMMARY OF THE INVENTION

An object of the present invention is to provide an ink jet recording sheet having a high gloss, an excellent adhesion between a polyolefin resin-coated substrate sheet and an ink receiving layer formed on the substrate sheet, a high ink drying rate and being capable of recording thereon ink images having a high uniformity.

The above-mentioned object can be attained by the ink jet recording sheet of the present invention which comprises a substrate comprising a base paper sheet and a polyolefin laminate layer formed by extrusion-laminating a polyolefin resin composition on at least a front surface of the base paper sheet; and an ink receiving layer formed on a surface of the polyolefin laminate layer of the substrate, wherein the surface of the polyolefin laminate layer is finely roughened and exhibits a center-line mean roughness (Ra) of 0.1 to 10 $\mu$m, determined in accordance with Japanese Industrial Standard B 0601-1982.

In the ink jet recording sheet of the present invention, the surface of the ink receiving layer preferably exhibits 75° specular glossiness of 30% or more, determined in accordance with Japanese Industrial Standard P8142-1993.

In the above-mentioned ink jet recording sheet of the present invention, the ink receiving layer preferably comprises at least one ink absorbing polymer selected from the group consisting of polyvinyl alcohol, cation-modified polyvinyl alcohols, polyvinyl pyrrolidone, cation-modified polyvinyl pyrrolidones, gelatin, phthalic acid-modified gelatins, casein, soybean casein, carboxyl-modified soybean caseins, starch, oxidized starchs, esterified starchs, phosphate-esterified starchs, carboxymethylcelluloce, hydroxyethylcellulose, methylcellulose, hydroxypropylmethylcellulose, and water-dispersible vinyl acetate copolymers.

In the ink jet recording sheet of the present invention, the finely roughened surface of the polyolefin laminate layer is preferably formed by bringing a extrusion-laminated polyolefin resin composition layer on the base paper sheet into contact with a peripheral surface of a cooling roll, to thereby adjusting the center-line mean roughness (Ra) of the resultant polyolefin laminate layer to 0.1 to 10 $\mu$m, determined in accordance with Japanese Industrial Standard B 0601-1982.

In the ink jet recording sheet of the present invention, optionally a backcoat layer is further formed on a back surface side of the substrate on which no ink receiving layer is formed, and a back-side intermediate layer is further formed between the back surface of the substrate and the backcoat layer to firmly bond the backcoat layer to the substrate therethrough.

In the ink jet recording sheet of the present invention, the backcoat layer preferably comprises at least one cellulose compound.

In the ink jet recording sheet of the present invention, the cellulose compound for the backcoat layer is preferably selected from the group consisting of cellulose nitrate,/cellulose acetate, cellulose acetate isopropionate, cellulose acetate butyrate, methylcellulose, ethylcellulose, hydroxymethylcellulose, hydroxyethylcellulose, carboxymethylcellulose, hydroxypropylcellulose, hydroxypropylmethylcellulose, carboxymethylhydroxyethylcellulose, carboxymethylhydroxyethylcellulose salts and carboxymethylcellulose salts.

In the ink jet recording sheet of the present invention, the back-side intermediate layer is preferably present in an amount of 0.001 to 1.0 g/m$^2$.

In the ink jet recording sheet of the present invention, the back-side intermediate layer preferably comprises an adhesive polymeric material selected from the group comprising hydrophilic polymeric materials and latices of water-insoluble polymeric materials.

The ink jet recording sheet of the present invention, optionally, further comprises a front-side intermediate layer formed between the polyolefin laminate layer of the substrate and the ink receiving layer, comprising at least one polymeric material selected from the group consisting of gelatin, polyvinyl alcohol and cation-modified polyvinyl alcohols, and exhibiting an ink absorption capacity of 0.1 ml/g or more, but less than 1.5 ml/g; and the ink receiving layer formed on the front-side intermediate layer exhibits an ink absorption capacity of 1.5 ml/g or more, but less than 10 ml/g.

In the ink jet recording sheet of the present invention, the ink drying rate, which is represented by a time between a stage at which ink images are ink jet-recorded on an ink jet recording sheet and a stage at which no transfer of the ink in the recorded ink images on the ink jet recording sheet to a wood-free paper sheet superposed on the ink jet recording sheet under pressure is found, of 50 minutes or less.

In the ink jet recording sheet of the present invention, preferably the front-side intermediate layer is present in an amount of 0.01 to 0.5 gl/m$^2$, and the ink receiving layer formed on the front-side intermediate layer is present in an amount of 3 to 50 g/m$^2$.

In the ink jet recording sheet of the present invention, the ink receiving layer preferably comprises at least one member selected from the group consisting of hydroxypropylmethylcellulose and polyvinyl pyrrolidone.

In the ink jet recording sheet of the present invention, the hydroxypropylmethylcellulose for the ink receiving layer preferably has a degree of substitution, which means, in glucose ring units of cellulose, an average number of hydroxyl groups substituted by methoxy group, of 1.5 or more.

In the ink jet recording sheet of the present invention, the ink receiving layer comprises a mixture of hydroxypropylmethylcellulose and polyvinyl pyrrolidone, in a mixing weight ratio of 100:10 to 100:150.

DESCRIPTION OF THE PREFERRED EMBODIMENTS

The inventors of the present invention carried out an extensive study on ink jet recording sheets having an ink receiving layer formed on a substrate consisting of a polyolefin resin-coated paper sheet and comprising, as a principal component, an ink-absorbing polymeric material. As a result, it was found that when a cellulose derivative is employed as an ink-absorbing polymeric material, the resultant ink jet recording sheets exhibit a high gloss, an improved ink drying rate and can record thereon ink images having excellent image quality, as reported in Japanese Unexamined Patent Publications No. 11-342,669, No. 2000-94826, and No. 2000-52649. However, it was also found that the cellulose derivatives exhibited an unsatisfactory adhesion to the surface of the polyolefin resin-coated paper substrate sheet.

In the present invention, the above-mentioned problem on the conventional ink receiving layer can be solved by finely roughening the surface of the polyolefin resin-coated paper substrate sheet to a specific surface roughness. Namely, by imparting a specific roughness to the surface of the polyolefin laminate layer of the substrate, the adhesion of the polyolefin laminate layer surface to the ink receiving layer can be improved, without causing the gloss of the ink receiving layer to be reduced.

In the ink jet recording sheet of the present invention, the substrate comprises a base paper sheet and a polyolefin laminate layer formed by extrusion-laminating a polyolefin resin composition on at least a front surface of the base paper sheet and an ink receiving layer formed on a surface of the polyolefin laminate layer of the substrate. In the formation of the polyolefin laminate layer, the polyolefin resin composition is melted, extruded through a film-forming slit, and laminated on the base paper sheet surface, and the polyolefin resin composition melt layer is cooled and solidified. During the cooling procedure, the layer of the polyolefin resin composition melt is brought into contact under pressure with a peripheral surface of a cooling roll having a specific roughness, to transfer the roughened surface pattern of the cooling roll to the resultant polyolefin laminate layer. In the ink jet recording sheet of the present invention, the surface of the polyolefin laminate layer of the substrate must exhibit a center-line mean roughness of 0.1 to 10 $\mu$m, preferably 0.2 to 7 $\mu$m, more preferably 0.5 to 5 $\mu$m determined in accordance with Japanese Industrial Standard (JIS) B 0601-1982.

The substrate usable for the present invention is a polyolefin resin-coated sheet produced by extrusion-laminating a polyolefin resin composition on at least one surface of a base paper sheet. The paper sheet for the base paper sheet comprises, as a principal component, a wood pulp. The wood pulp usable for the present invention is preferably selected from chemical pulps, for example, LBKP and NBKP, mechanical pulps, for example, GP, PGW, TMP, CTMP, CMP and CGP, and waste paper pulps, for example DIP. The wood pulp may be mixed with a conventional additive for paper making. The paper-making additive includes pigments usable for paper-making, binders, sizing agents, fixing agents, yield-improving agent, cation-modifying agents, dry strength-enhancing agents, wet strength-enhancing agents, pH-regulating agents, electro-conductive agents, and dyes. These additives may be added alone or in a mixture of two or more thereof. The paper-making machine may be selected from conventional wire paper machines, cylinder paper machines and twin wire paper machines. The pulp slurry may be either acid, neutral or alkaline.

The resultant paper sheet may be tub-sized or size-pressed with a sizing agent, for example, starch or polyvinyl alcohol, and/or surface-smoothed by a machine calender, thermal calender, soft calender, or super calender.

There is no limitation to the base paper sheet. Usually, the base paper sheet preferably has a thickness of 30 to 500 $\mu$m, more preferably 50 to 250 $\mu$m. If the thickness is less than 30 $\mu$m, the resultant ink jet recording sheet may exhibit too low a rigidity and may unsatisfactory in hand, weight and transparency thereof. Also, if the thickness is more than 500 $\mu$m, the resultant ink jet recording sheet may exhibit too high a rigidity and may be unsatisfactory in handling property and in passing through printer, and thus a problem may occur when the recording sheets are fed into and delivered from the printer.

The polyolefin resin composition for the polyolefin laminate layer comprises, as a principal component, a polyolefin resin, and as optional components, a white-coloring pigment or other additive. The polyolefin resin is preferably selected from homopolymers and copolymers of ethylene and propylene. These polyolefin resins may be employed alone or in a mixture of two or more thereof. Among these polyolefins, low density polyethylenes, medium density polyethylenes, high density polyethylenes, liner low density polyethylenes and polypropylenes have a high processability and are easily available, and thus are advantageously employed for the present invention. There is no limitation to specific physical and chemical properties of the polyolefin resin. However, in view of processability and resistance to curling, preferably the polyolefin resin has a number average molecular weight of 20,000 to 200,000, a density of 0.915 to 0.950 g/cm$^3$, and a melt index of 2 to 40 g/10 min., determined in accordance with Japanese Industrial Standard K 6760-1977.

In the polyolefin laminate layer on which the ink receiving layer is coated, preferably a white-coloring pigment is contained to enhance the whiteness and opacity of the polyolefin laminate layer and to render the clarity of the recorded ink images.

The white-coloring pigment preferably contains at least one member selected from anatase titanium dioxide, rutil titanium dioxide, zinc oxide,-calcium carbonate and talc. The particles of the white-coloring pigment usually have an average particle size of about 1 $\mu$m or less, and preferably have an average particle size of 0.5 $\mu$m or less to cause the surface of the resultant polyolefin laminate layer to exhibit the above-mentioned target center-line mean roughness Ra. There is no specific limitation to the content of the white-coloring pigment in the polyolefin laminate layer. Usually, the content of the white-coloring pigment is preferably 0.1 to 30 parts by weight, more preferably 1 to 15 parts by weight, per 100 parts by weight of the polyolefin resin. If the pigment content is less than 0.1 parts by weight, the enhancing effects of the pigment on the whiteness and the opacity may be insufficient, and if the content is more than 30 parts by weight, the particles of the pigment are difficult to evenly disperse in the polyolefin resin matrix. To improve the dispersion of the white-coloring pigment particles in the polyolefin resin matrix, the surfaces of the pigment particles may be surface-treated with aluminum or a silane coupling agent.

The additives other than the white-coloring pigment for the polyolefin laminate layer are preferably selected from dispersing agents, surfactants, coloring pigments, dyes, fluorescent brightening agents, antioxidants and plasticizers.

The mixing procedure of the polyolefin resin with the white-coloring pigments and the addtitives can be carried out by an extruder for kneading, a heating roll kneader, a Banbury kneader or a press kneader.

The polyolefin laminate layer is formed by a extrusion-laminating procedure. Namely, a polyolefin resin composition is melted in a melt extruder and extruded through a film-forming slit die of the extruder into a form of a thin film, and the extruded stream of the polyolefin resin composition melt is laminated on a surface of a base paper sheet while the base paper sheet passes through the laminater. In this laminating procedure, the extruded melt stream of the polyolefin resin composition has a temperature of 200 to 350° C. which is variable in response to the type of the polyolefin resin. The slit die is preferably selected from T-type die, L-type die, fish tail type die, and flat die, and the width of the slit opening is preferably about 0.1 to 2 mm.

In the lamination of the polyolefin laminate layer on the base paper sheet, the cooling roll for cooling the filing melt stream of the polyolefin resin composition has a finely roughened peripheral surface. The finely roughened peripheral surface is formed by a surface-grinding procedure, surface vapor deposition procedure, sandblast procedure, etching procedure, electrochemical corroding procedure, and plating procedure. In view of an excellent roughening effect, the sandblast method is preferred.

The periphery of the cooling roll is made from a metallic material, for example, iron, stainless steel, or aluminum, and the metal surface is preferably surface-treated by a nickel-plating method, a chromium-plating method, an enameling method or a polytetrachloroethylene-coating method.

There is no specific limitation to the type of the metallic material for the cooling roll, and to the roughened surface-forming method, as long as the cooling roll can form the target roughened surface on the polyolefin laminate layer. Usually, an iron-made, chromium-plated cooling roll of which the surface is roughened by the sandblast method, is preferably employed for the present invention. This type of cooling roll exhibit a high roughening effect on the polyolefin laminate layer surface.

In the extrusion-laminating procedure, the pressing linear pressure of the cooling roll on the polyolefin laminate layer is preferably about 98.1 to 980.7 N/cm (10 to 100 kg/cm), more preferably 196.2 to 490.4 N/cm. Since an increase in the surface temperature of the cooling roll causes the separation of the resultant polyolefin laminate layer from the cooling roll periphery to be obstructed, the cooling roll periphery should be cooled to a temperature of 5 to 50° C., by, for example, circulating cooling water over the inside surface of the rolling roll, to promote the process-applicability of the cooling roll.

In the ink jet recording sheet of the present invention, the polyolefin laminate layer must exhibit a center-line mean roughness (Ra) of 0.1 to 10 μm, preferably 0.2 to 7 μm, still more preferably 0.5 to 5 μm, determined in accordance with Japanese Industrial Standard B 0601-1982. If the Ra is less than 0.1 μm, the resultant polyolefin laminate layer surface is unsatisfactory in adhesion to the ink receiving layer formed thereon, and if the Ra is more than 10 μm, the resultant surface of the ink receiving layer formed on the polyolefin laminate layer exhibits an unsatisfactory gloss. Thus, the Ra of the polyolefin laminate layer surface must be controlled to 0.1 to 10 μm, to obtain both a high gloss of the ink receiving layer and a high color density of the ink images recorded on the ink receiving layer.

The mechanism of improving the coating property of the polyolefin laminate layer surface by controlling the Ra value thereof in accordance with the present invention is not fully clear. It is assumed, however, that the fine concave and convex shapes formed on the polyolefin laminate layer surface contribute to preventing generation of fine air bubbles between the surface of the polyolefin laminate layer and the wetted coating layer of the coating liquid for the ink receiving layer.

The substrate optionally has a polyolefin laminate layer formed on a surface (a back surface) of the base paper sheet opposite to the surface (front surface) on which the ink receiving layer is supported.

The front and back polyolefin laminate layers are preferably formed each in an amount of 5 to 50 g/m$^2$ and more preferably 10 to 30 g/m$^2$. If the laminating amount is less than 5 g/m$^2$, the adhesion between the resultant polyolefin laminate layer and the base paper sheet may be insufficient or the resultant polyolefin laminate layer may have an unsatisfactory evenness. Also, if the laminating amount is more than 50 g/m$^2$, the resultant recording sheet may have too large a thickness and may exhibit a reduced resistance to curling thereof, and production cost of the recording sheet may be too high.

Each of the front and back polyolefin laminate layer may be formed in a single layer structure or in a two or more-layered structure. When the polyolefin laminate layer is formed from two or more divisional thin layers superposed on each other, these divisional layers may be formed from the same resin composition as each other, or from two or more resin compositions different from each other the two or more divisional layers may be laminated successively or simultaneously by using a co-extruding method.

The surface of the front polyolefin laminate layer on which the ink receiving layer is formed may be surface-activated by, for example, a corona discharge treatment, or may be coated with a thin undercoat layer comprising a water-soluble resin, for the purpose of enhancing the bonding strength between the front polyolefin laminate layer and the ink receiving layer.

The back surface of the substrate, on which no ink receiving layer is formed, may be coated with a backcoat layer for the purpose of preventing curling of the recording sheet, or enhancing the passing of the recording sheet through the printer, or imparting an antistatic property and/or a pencil-writable property to the back surface.

There is no specific limitation to the type or composition of the ink receiving layer, as long as the resultant ink receiving layer has a satisfactory ink receiving property. Preferably, the ink receiving layer contains at least one ink-absorbing polymer.

The ink absorbing polymer is referred to as a polymer capable of absorbing an ink jetted imagewise from the ink jet recording printer. The ink-absorbing polymer preferably selected from the group consisting of water-soluble polymers, for example, polyvinyl alcohol, modified polyvinyl alcohols, for example, cation-modified polyvinyl alcohols, and silanol-modified polyvinyl alcohols; polyvinyl pyrrolidone, modified polyvinyl pyrrolidones, for example, cation-modified pyrrolidones; gelatin, modified gelatins, for example, phthalic acid-modified gelatins; casein, soybean casein, modified soybeans caseins, for example, carboxyl-modified soybean caseins, starch, starch derivatives, for example, oxidized starchs, etherified starchs, and phosphate esterified starchs; cellulose derivatives, for example, corboxymethylcelluloce, hydroxyethylcellulose, methylcellulose, and hydroxypropylmethylcellulose; and water-dispersible vinyl acetate copolymers.

In view of a high ink-absorbing property, the water-soluble polymers are preferably employed for the present invention.

The ink receiving layer comprising a cellulose derivative, polyvinyl pyrrolidone and a cationic polymer is advantageous in that the ink-drying property is high, and clear ink images can be recorded thereon, and the stickiness is very low.

The ink receiving layer optionally comprises, in addition to the ink-absorbing polymer, at least one additive selected from, for example, cationic polymers, blocking-preventing agents, ink-fixing agents, pigments, pigment-dispersing agents, thickness, fluidity-improving agents, surfactants, defoaming agents, foam-controlling agents, diffusing agents, coloring dyes, coloring pigments, fluorescent brightening agents, ultraviolet-ray absorbing agents, antioxidants, preservative agents, mildew-proofing agents and water-proofing agents.

The cationic polymers serve as an ink-fixing agent. The cationic polymers are preferably selected from those having reactive groups capable of reacting with sulfonic acid groups, carboxyl groups and or amino groups of dyes, for example, water-soluble direct dyes and water-soluble acid dyes which are contained in the aqueous inks for the ink jet printers and cationic polymers having secondary amino groups tertiary amino groups and/or quaternary ammonium salt groups.

For example, the cationic resins are preferably selected from polyethyleneimine, polyvinyl pyridine, polydialkylaminoethyl methacrylate, polydialkylaminoethyl acrylate, polydialkylaminoethyl methacrylamide, polydialkylaminoethylacrylamide, polyepoxyamine, polyamideamine, dicyandiamideformaldehyde polycondensation products, dicyandiamidepolyalkylpolyalkylenepolyamine condensation products, polydimethylallyl ammonium chloride, polyvinyl amine, polyallylamine and modification products of the above-mentioned compounds.

The pigment added to the ink receiving layer contributes to preventing the blocking phenomenon of the resultant ink jet recording sheets for the printer. Generally, there is no limitation to the content of the pigment in the ink receiving layer. However, when the pigment particles having a particle size of several μm are added to the ink receiving layer, if the amount of the pigment particles is too large, the resultant ink receiving layer may exhibit a reduced gloss. Thus, the pigment is preferably contained in a content of 10 parts by weight or less, more preferably 3 parts by weight or less, still more preferably 1 part by weight or less, per 100 parts by weight of the ink-absorbing polymer.

Also, the pigment particles having a particle size of 1 μm or less exhibit a low influence on the reduction of the gloss of the resultant ink receiving layer. Thus, the ink absorbing property of the ink receiving layer can be improved by adding a large amount of the fine pigment particles. In this case, the fine pigment particles may be added in an amount of 400 parts by weight or less per 100 parts by weight of the ink-absorbing polymer.

The ink receiving layer is preferably formed in a dry weight of 3 to 30 g/m$^2$, more preferably 5 to 20 g/m$^2$. If the dry weight is less than 3 g/m$^2$, the resultant ink receiving layer may not fully absorb the inks for full color printing. If the dry weight of the ink receiving layer is more than 30 g/m$^2$, the resultant ink jet recording sheet may be too thick and may exhibit a high curling property and may be too expensive.

The ink receiving layer surface of the recording sheet of the present invention preferably exhibits a 75° specular glossiness of 30% or more, more preferably 50% or more, still more preferably 70% or more, further preferably 80% or more, determined in accordance with Japanese Industrial Standard (JIS) P8412-1993. When the ink receiving layer has the above-mentioned gloss, the resultant ink images recorded thereon have a high color density and a high gloss.

In the preparation of the ink jet recording sheet of the present invention, the ink receiving layer may be coated by a conventional coating method and apparatus, for example, a blade coater, a roll coater, an air knife coater, a bar coater, a rod blade coater, a short dwell coater, a gravure coater an extrusion coater or a curtain coater.

In an embodiment of the ink jet recording sheet of the invention, the ink recording sheet further comprises a backcoat layer formed on a back surface side of the substrate on which no ink receiving layer is formed, and a back-side intermediate layer formed between the back surface of the substrate and the backcoat layer to firmly bond the backcoat layer to the substrate.

The backcoat layer may be formed on a polyolefin laminate layer formed on a back surface of the base paper sheet.

In this embodiment, the back-side intermediate layer preferably comprises an adhesive polymeric material selected from the group comprising hydrophilic polymeric materials and latices of water-insoluble polymeric materials.

The hydrophilic polymeric material for the back-side intermediate layer preferably comprises at least one member selected from gelatin compounds and polymers having hydroxyl groups.

Also, in this embodiment, the back-side intermediate layer preferably comprises an adhesion-enhancing agent for promoting the adhesion between the backcoat layer and the polyolefin laminate layer.

The back polyolefin laminate layer may be formed by the same extrusion-laminating procedure for the front polyolefin laminate layer. The coating roll for the back polyolefin laminate layer may have a mirror-finished peripheral surface, but preferably has a roughened peripheral surface.

There is no limitation to the coating amount of the back polyolefin laminate layer. Usually, the coating weight of the back polyolefin laminate layer is preferably 5 to 50 g/m$^2$, more preferably 10 to 30 g/m$^2$. If the coating weight is less than 5 g/m$^2$, the resultant back polyolefin laminate layer may exhibit an insufficient adhesion to the base paper sheet and if it is more than 50 g/m$^2$, the resultant substrate may be too thick and may have too high a cost.

The type and the coating amount of the front and back polyolefin laminate layers influence the curling property of the resultant ink jet recording sheet. Thus the curling property of the secondary sheet can be controlled by using polyolefin resins different in density, derived from a difference in crystallinity, for the back and front polyolefin laminate layers, or by differentiating the coating weight between the front and back polyolefin laminate layers.

The ink receiving layer for this embodiment is the same as mentioned above. Preferably, the ink receiving layer contains the ink-absorbing polymeric material in an amount of 70% by weight or more, more preferably 85% or more.

The ink receiving layer for this embodiment, may contain a pigment. The pigment preferably comprises at least one member selected from synthetic amorphous silica, precipitated calcium carbonate, ground calcium carbonate, magnesium carbonate, alumina, aluminosilicate, kaolin, clay, satin white, diatomaceous, calcium sulfate, barium sulfate, calcium silicate, magnesium silicate, titanium dioxide, magnesium hydroxide, synthetic zeolite, zinc oxide, zinc sulfide, zinc carbonate, styrene plastic polymer pigments, acrylic polymer pigments, microcapsule pigments, and colloidal silica. The pigment is contained in an amount which does not cause the gloss of the resultant ink receiving layer to be decreased. In this case, the surface of the ink receiving layer is appropriately roughened and the resultant ink jet recording sheets exhibit a high resistance to blocking for printer.

The ink receiving layer optionally contains the same additive as mentioned above.

In the backcoat layer for this embodiment, there is no specific limitation to the type of the material for forming the backcoat layer, as long as the resultant backcoat layer contributes to enhancing the resistance of the recording sheet to curling. Generally, the backcoat layer formed from a cellulose compound exhibit a high resistance to curling and a high resistance to adhesion to the ink receiving sheet of an adjacent recording sheet superposed thereon, and can prevent blocking of the printer.

The cellulose compound refers to cellulose and cellulose derivatives. The cellulose derivative are preferably selected from esterified cellulose and etherified celluloses produced by reacting the hydroxyl groups contained in the glucose units from which the cellulose is constituted.

The cellulose esters include, for example, cellulose nitrate, cellulose acetate, cellulose acetate propionate and cellulose acetate butyrate. The cellulose ethers include, for example, methyl cellulose, ethyl cellulose, hydroxyethylcellulose, carboxymethylcellulose, hydroxypropylcellulose, hydroxypropylcellulose, and carboxymethylhydroxyethylcellulose. The cellulose compound include cellulose salts, for example, sodium salt of carboxymethylcellulose. Among the above-mentioned cellulose compounds, the carboxymehtylcellulose salts, for example sodium salt of carboxymethylcellulose, and hydroxypropylmethylcellulose and hydroxyethylcellulose are preferably employed for forming the backcoat layer having a good curl-preventing property and a good blocking-preventing property even when they are coated in a relatively small amount.

In the cellulose compound, there is no limitation to a degree of substitution of the hydroxyl groups. However, the water solubility of the cellulose component varies in response to the degree of substitution of the hydroxyl groups. Thus, when the cellulose compound is employed in an aqueous coating liquid, the degree of substitution of the hydroxyl groups should be controlled so that the resultant cellulose compound exhibits a water-solubility. For example, in the case of sodium salt of carboxymethylcellulose, the degree of substitution of the hydroxyl groups is preferably 0.4 or more. There is no limitation to the degree of polymerization of the cellulose compound. The viscosity of the cellulose compound significantly increases with increase in the degree of substitution. Thus, the cellulose compound should be selected in consideration of the coating property thereof. Usually, the cellulose compound preferably has a degree of polymerization of 50 to 5,000.

In the formation of the backcoat layer, the above-mentioned cellulose compounds may be employed alone or in a mixture of two or more thereof.

The backcoat layer may contain, in addition to the cellulose compound, at least one member selected from polyvinyl alcohol, polyvinyl acetal, polyvinylyl pyrrolidone, polyesters, acrylic polymers, polyacrylate esters, styrene polymers, styrene-butadiene copolymers, gelatin, casein, starch compounds, and latices of water-insoluble polymers.

The back-side intermediate layer enhances the adhesion between the back surface of the substrate and the backcoat layer. There is no limitation to the type and amount of the material for forming the back-side intermediate layer. Generally, the back-side intermediate layer preferably comprises a hydrophilic polymeric material and is present in an amount of 0.01 to 0.5 g/m$^2$.

The hydrophilic polymeric material for the back-side intermediate layer preferably comprises at least one member selected from polyvinyl alcohol, modified polyvinyl alcohols, for example, cation-modified polyvinyl alcohols, and silanol-modified polyvinyl alcohols, polyvinyl pyrrolidone, modified polyvinyl pyrrolidones, for example, cation-modified polyvinyl pyrrolidones, gelatin, modified gelatins, for example, phthalic acid-modified gelatins, casein, soybean casein, modified soybean caseins, for example, carboxyl-modified soybean caseins, starch, starch derivatives, for example oxidized starchs, etherified starchs, phosphate ester-modified starchs, and cellulose derivatives, for example, methylcellulose, carboxymethylcellulose, hydroxyethylcellulose, hydroxypropylmethylcellulose, and latices of water-insoluble polymers. Preferably, hydrophilic polymers having hydroxyl groups are employed for the back-side intermediate layer.

Among these hydrophilic polymers, the gelatin compounds and the polyvinyl alcohol compounds are advantageously utilized for the present invention. Particularly, the gelatin compounds exhibit a high effect on the improvement of the adhesive property of the back-side intermediate layer, and thus are employed for the back-side intermediate layer of the present invention.

The gelatin is produced mainly from cowbone, cowhide and pigskin and comprises, as a principal component, collagen which is a protein extracted and refined by a lime treatment and/or an acid treatment. All the gelatins available in trade can be used for the present invention. There is no limitation to molecular weight, distribution of the molecular weight, isoionization point, jelly strength, water retention, and film-forming property of the gelatin compounds.

The gelatin may be modified by reacting the amino groups and/or the carboxyl groups in the gelatin with reactive compounds, for example, dicarboxylic acids. The modified gelatins may be used for the present invention. For example, the gelatin may be modified with succinic anhydride to provide a succinate-modified gelatin.

The back-side intermediate layer is preferably formed in a coating weight of 0.005 to 1.0 g/m$^2$ and, more preferably 0.01 to 0.5 g/m$^2$. If the coating weight is too small, the resultant back-side intermediate layer may be unsatisfactory in the adhesion-enhancing effect between the substrate and the backcoat layer. If the coating weight is too large, the resultant ink jet recording sheet may exhibit a low resistance to curling, especially, in a low temperature low humidity circumstance, the recording sheet may be greatly curled, or the adhesion between the substrate sheet and the backcoat layer may be degrated.

The back-side intermediate layer by coated by a conventional coating method and the coater may be, for example, a blade coater, a roll coater, an air knife coater, a bar coater, a rod blade coater, a short dwell coater, a gravure coater, an extrusion coater, or a curtain coater. Among the above-mentioned coaters, the gravure coater enables the back-side intermediate layer to exhibit a good surface property in the coating weight in the above-mentioned range, and thus is advantageously employed for the present invention.

The back-side intermediate layer may be directly coated on the back surface of the substrate sheet. Alternatively, the back surface of the substrate sheet is surface-activated by a corona discharge treatment or a flame treatment for the purpose of enhancing the adhesive property of the back surface of the substrate sheet, and then the surface-activated back surface of the substrate sheet is coated by the back-side intermediate layer.

Also, to enhance the adhesive property of the back-side intermediate layer to the back polyolefin laminate layer of the substrate sheet, an adhesive property-enhancing agent may be added to the back-side intermediate layer. The adhesive property-enhancing agent preferably comprises at least one hydrophobic polymeric material, selected from, for example, aqueous dispersions of polyolefin resins, aqueous dispersions of polyester resins and aqueous emulsions of ethylene-vinyl acetate copolymers, which have hydrophobic moieties in the molecules thereof, having a high affinity to the polyolefin resins.

The polyolefin resin dispersions include those available in the trademark of CHEMIPEARL (for example, CHEMIPEARL S-100, S-120, SA-100 and V-100) from MITSUI SEKIYUKAGAKUKOGYO K.K.

The polyester resin dispersions include those available under the trademark of PESRESIN (for example, PESRESIN A-510, PESRESIN A-515G, PESRESIN A-513E and PESRESIN NT-3,) from TAKAMATSU YUSHI K.K.

The ethylene-vinyl acetate copolymer resins include those available under the trademark of AQUATEX (for example, AQUATEX HA1100, AQUATEX MC3800 and AQUATEX MC4400) from CHUO RIKAKOGYO K.K.

There is no limitation to the content of the adhesive property-enhancing agent in the back-side intermediate layer. Usually, the adhesion property-enhancing agent is preferably employed in an amount of 0.5 to 30 parts by weight, more preferably 3 to 15 parts by weight per 100 parts by weight of the polymeric matrix comprising, as a principal component, the cellulose compound. If the content is too small, the resultant adhesive property-enhancing effect may be unsatisfactory, and if the content is too large, the curl-preventing effect of the back-side intermediate layer may be decreased.

The backcoat layer optionally contains a pigment to control the friction of the backcoat layer, to impart a pencil writing property to the backcoat layer, and/or to prevent the blocking of the printer.

The pigment for the backcoat layer preferably comprises at least one member selected from synthetic amorphous silica, precipitated calcium carbonate, ground calcium carbonate, magnesium carbonate, alumina, aluminosilicate, kaolin, clay, satin white, diatomaceous, calcium sulfate, barium sulfate, calcium silicate, magnesium silicate, titanium dioxide, magnesium hydroxide, synthetic zeolite, zinc oxide, zinc sulfide, zinc carbonate, styrene plastic polymer pigments, acrylic polymer pigments, microcapsule pigments, and colloidal silica. The content of the pigment is variable in response to the particle size, the particle form of the pigment, the type of the cellulose compound contained in the backcoat layer, and the coating amount of the backcoat layer. Usually, the content of the pigment in the backcoat layer is, preferably, 50% by weight or less of the total weight of the backcoat layer. If the pigment content is too high, the curl-preventing effect of the resultant backcoat layer may be insufficient. Thus, more preferably, the pigment content is 10% by weight or less.

The backcoat layer optionally further contains at least one member selected from surfactants, pigment dispersing agents, thickening agents, fluidity-enhancing agents, defoaming agent, antifoaming agent, releasing agents, foaming agents, penetrating agents, coloring pigments, coloring dyes, fluorescent brightening agents, ultraviolet ray-absorbing agents, antioxidants, preservative agent, mildew proofing agents, and waterproofing agents.

The backcoat layer of the present invention can be formed by a conventional coating method and coater, for example, a blade coater, roll coater, air knife coater, bar coater, rod blade coater, short dwell coater, gravure coater, extrusion coater or curtain coater.

The coating amount of the backcoat layer is preferably in the range of from 3 to 50 g/m$^2$, more preferably 5 to 30 g/m$^2$. If the coating amount is too large, too large backcurling may occur, the resultant ink jet recording sheet is too thick and too costly. The backcoat layer may be utilized as a recording layer. In this case, the recording sheet has two recording surfaces.

In another embodiment of the ink jet recording sheet of the present invention, the ink jet recording sheet further comprises a front-side intermediate layer formed between the polyolefin laminate layer of the substrate and the ink receiving layer, comprising at least one polymeric material selected from the group consisting of gelatin, polyvinyl alcohol and cation-modified polyvinyl alcohols, and exhibiting an ink absorption capacity of 0.1 ml/g or more, but less than 1.5 ml/g; and the ink receiving layer formed on the front-side intermediate layer exhibits an ink absorption capacity of 1.5 ml/g or more, but less than 10 ml/g.

In this embodiment, preferably, the ink receiving layer exhibits an ink drying rate of 50 minutes or less. The ink drying rate is represented by a time period between a stage at which ink images are ink jet-recorded on an ink jet recording sheet and a stage at which no transfer of the ink in the ink images recorded on the ink jet recording sheet to a wood-free paper sheet is found.

In this embodiment of the ink jet recording sheet of the present invention, the front-side intermediate layer is preferably present in an amount of 0.01 to 0.5 g/m$^2$, and the ink receiving layer formed on the front-side intermediate layer is preferably present in an amount of 3 to 50 g/m$^2$.

In this embodiment, the ink receiving layer preferably comprises at least one member selected from the group consisting of hydroxypropylmethylcellulose and polyvinyl pyrrolidone.

In this case, the hydroxypropylmethylcellulose for the ink receiving layer preferably has a degree of substitution, which means, in glucose ring units of cellulose, an average number of hydroxyl groups, substituted by a methoxy group, of 1.5 or more.

Also, in this embodiment, the ink receiving layer preferably comprises a mixture of hydroxypropylmethylcellulose and polyvinyl pyrrolidone, in a mixing weight ratio of 100:10 to 100:150.

In each of the front-side intermediate layer and the ink receiving layer of the ink jet recording sheet of the present invention, the ink-absorbing capacity is measured by the following procedure.

A surface of a transparent polyester film (trademark: LUMILER, made by TORAY) is surface-activated by applying a corona discharge treatment thereto, then the activated surface is coated with a coating liquid composition for the front-side intermediate layer or the ink receiving layer by using an applicater, and the coating liquid composition layer is dried to form a coating layer having a dry weight of 10 g/m$^2$. The resultant coating layer is moisture-controlled at a temperature of 20° C. at a relative humidity (RH) of 65% until no increase and decrease in moisture content of the coating layer is detected. The resultant ink jet recording sheet is fed into a ink jet recording full color printer (trademark: PM700C, made by EPSON K.K.) and is printed with ink images in the same pattern as each other but different in color density from each other. Ten minutes after the printing, a wood-free paper sheet moisture-controlled in the same manner as mentioned above is superposed on and pressed to the ink image-printed surface of the recording sheet and then is separated from the recording sheet with respect to the surface of the wood-free paper sheet which has been brought into contact with the printed surface of the recording sheet, it is checked whether or not the ink images are transferred to the wood-free paper sheet. An amount of the ink in ml/m$^2$ applied to the ink images corresponding to the color density in which the ink images are not transferred to the wood-free paper sheet is established. Then, from the established ink amount in ml/m$^2$, an amount of ink per g/m$^2$ of the dry weight of the front-side intermediate layer or the ink receiving layer is calculated. The resultant ink amount represents an ink absorption capacity in ml/g of the front-side intermediate layer or the ink receiving layer.

The amount in ml/m$^2$ of the ink applied from the color printer (trademark: PM 700C, made by EPSON) to the front-side intermediate layer or the ink receiving layer for each color density, namely the amount of the ink extruded from an exclusive ink cartridge (black-coloring ink, trademark: MJIC7, made by EPSON) for the printer is determined by printing a pre-determined area of the wood-free paper sheet with the ink extruded from the ink cartridge, and by calculating the difference in the weight of the ink cartridge before and after the printing.

The type and content of solvent contained in the ink are variable in response to the color of the ink. However, as long as the relative difference in ink absorption capacity between the front side intermediate layer and the ink receiving layer is known, there is no difficult in the determination of the ink absorption capacity of the layers.

In this embodiment, the polyolefin resin coated substrate sheet is the same as mentioned above.

The ink receiving layer is the same as mentioned above and comprises, as a principal component, ink-absorbing polymeric material which preferably comprises at least one member selected from, for example, polyvinyl pyrrolidone, modified polyvinyl pyrrolidones, for example, cation-modified pyrrolidones; vinyl pyrrolidone-vinyl acetate copolymers, polyvinyl alcohol, modified polyvinyl alcohols, for example, cation-modified polyvinyl alcohols and silanol-modified polyvinyl alcohol, polyvinyl acetal, polyethyleneglycol, polyethyleneoxide, polyamides, polyacrylaimide, gelatin modified gelatins, for example, phthalic acid-modified gelain, casein, soybean casein, modified soybean caseins, for example, carboxyl-modified soybean caseins, starch, starch derivatives, for example, oxidized starchs, etherified starchs and phosphate-esterified starchs, cellulose compounds, for example, carboxymthylcellulose, hydroxyethylcellulose, methyl cellulose, hydroxypropylmethylcellulose, albumin, gum arabic, sodium alginate, copolymers of vinyl alcohol with olefins, copolymers of styrene with maleic anhydride cross-linking reaction product with polyethyleneoxide with isocyanate compounds, graft-polymerization products of polyvinyl alcohol with methacrylamide, acrylic polymer having carboxyl groups, cross-linking acrylic polymers. These polymers may be employed alone or in a mixture of two or more thereof. Among these polymers, hydroxypropylmethylcellulose or polyvinyl pyrrolidone enable the resultant ink receiving layer to exhibit high ink absorption, a high ink drying rate and a high resistance to blotting of the ink images, and thus are preferably employed for the present invention.

There is no specific limitation to the average molecular weight of hydroxypropylmethylcellulose. Usually, the hydroxypropylmethylcellulose preferably has a weight average molecular weight of 80,000 to 170,000. The hydroxypropylemethylcellulose having a degree of substitution of the hydroxyl groups with methoxy groups, which degree is represented by an average number of the methoxy groups substituted for the hydroxyl groups contained in glucose ring units in the cellulose molecules, of 1.5 or more, contributes to enhancing the ink absorption of the ink receiving layer, color density of the recorded ink images, and the gloss of the ink receiving layer, and thus is advantageously employed for the present invention. If the degree of substitution is less than 1.5, the resultant ink receiving layer may exhibit an unsatisfactory transparency and an insufficient gloss. The degree of substitution is more preferably 1.8 or more. There is no upper limit for the degree of substitution. In view of the number of the hydroxyl groups contained each glucose ring group of cellulose, the upper limit is 3 or less. In the hydroxypropylmethylcellulose, there is no limitation to the average number of the addition-reacted hydroxypropyl groups. Usually, the average molar amount of the addition-reacted hydroxypropyl group is preferably 0.10 to 0.34 moles, more preferably 0.15 to 0.30 moles per mole of the glucose ring units.

Also, when hydroxypropylmethylcellulose is employed together with polyvinyl pyrrolidone, the resultant ink jet recording sheet exhibits enhanced ink absorption, ink drying rate, resistance to ink-blotting, color density and evenness of the recorded ink images, a decreased sticking property of the ink-recorded surface thereof, and an improved applicability to aqueous pigment inks.

In the mixture of hydroxypropylmethylcellulose with polyvinyl pyrrolidone, the polyvinyl pyrrolidone is preferably present in an amount of 10 to 150 parts by weight per 100 parts by weight of the hydroxypropylmethylcellulose. When the amount of the polyvinyl pyrrolidone is less than 10 parts by weight, the applicability-improving effect of the resultant ink receiving layer to the aqueous pigment ink printing may be insufficient. When the polyvinyl pyrrolidone amount is more than 150 parts by weight, the resultant ink receiving layer may exhibit an unsatisfactory ink drying rate, resistance to ink image-blotting, and poor sticking-prevention. In the mixture, the polyvinyl pyrrolidon is more preferably contained in an amount of 18 to 82 parts by weight. The polyvinyl pyrrolidone may be replaced by a vinyl pyrrolidone-vinyl acetate copolymer, a vinyl pyrrolidone-quaternary methylvinyl imidazolium salt copolymer, or a vinyl pyrrolidone-acrylic acid copolymer. The polyvinyl pyrrolidone preferably has a weight average molecular weight of 5,000 to 100,000.

In the ink receiving layer, a cationic polymer having an ink-fixing property may be contained to enhance the water resistance of the recorded ink images.

The cationic polymer is preferably contained in a content of 30% by weight or less based on the total weight of the ink receiving layer. When the content of the cationic polymer is more than 30% by weight, the resultant ink receiving layer may exhibit an unsatisfactory ink absorption, a low ink drying rate and a poor white sheet gloss.

The cationic polymer usable for the present invention includes various cationic polymers capable of reacting with sulfonate groups and carboxyl groups contained in the coloring dye molecules and pigment molecules for the inks for the ink jet recording system, which are selected from secondary, tertiary and quaternary ammonium salt group-containing cationic polymers.

Particularly, the cationic polymer is preferably selected from polyethylenimine, polyvinyl pyridine, polyvinyl amine, polymers of monoallylamine chloride, polymers of diallylamine chloride, monoallylamine chloride-diallylamine chloride copolymers, polymers of (meth) acrylamidoalkyl quaternary ammonium salts, polyalkylenepolyamine-dicyandiamide polycondensation products, secondary amine-epichlorohydrin adducts, polyepoxyamines, polydimethyldiallyl ammonium chloride, polyallylamine chloride, allylamine-diallylamine copolymers, (meth)acrylamide-diallylamine copolymers, epichlorohydrinpolyamide, polydiallylaminoethyl acrylamide, dicyandiamidopolyethyleneamine and polydimethylamine ammonium epichlorohydrin.

Also, the ink receiving layer may contain the additives as mentioned above.

In this embodiment of the ink jet recording sheet of the present invention, the front-side intermediate layer comprises, as a principal component, a polymeric material capable of absorbing ink for ink jet recording. The ink absorbing polymeric material preferably comprises at least one member selected from gelatin, polyvinyl alcohol and modified polyvinyl alcohols. Among the ink absorbing polymers, gelatin and the polyvinyl alcohol contribute to enhancing the adhesion of the front-side intermediate layer to the polyolefin laminate layer of the substrate sheet and the adhesive strength between the front-side intermediate layer and the ink receiving layer, before printing, and the adhesion between the front polyolefin laminate layer and the front-side intermediate layer and the adhesive strength between the front-side intermediate layer and the ink receiving layer after it is printed, and thus are advantageously employed for the present invention.

The gelatin for the front-side intermediate layer may be selected from those made from water-insoluble animal collagen material. Preferably, the gelatin for the present invention is selected from those prepared from collagen produced from pigskin, cowhide and cowbone. There is no limitation to the type of gelatin. Usually, alkali method (line treatment) gelatins, acid method gelatins, desalted gelatins prepared from the alkali method gelatins and acid method gelatins prepared by an ion-exchange method, and modified gelatins, for example phthalate-modified gelatins and succinate-modified gelatins, can be utilized for the present invention.

There is no limitation to the average molecular weight, molecular weight distribution, isoionization point, jelly strength water retention and film-forming property. The above-mentioned gelatins may be used alone or in a mixture of two or more thereof.

The polyvinyl alcohol for the front-side intermediate layer may be selected from trade available polyvinyl alcohols. The polyvinyl alcohol is usually produced by polymerizing vinyl acetate and saponifying the resultant polyvinyl acetate. There is no limitation to the degree of polymerization and the degree of saponification of the resultant polyvinyl alcohol. The completely saponified polyvinyl alcohols and partially saponified polyvinyl alcohols and modified polyvinyl alcohols are employed alone or in a mixture of two or more thereof. The completely saponified polyvinyl alcohols usually have a degree of saponification of about 90 to 99% and the partially saponified polyvinyl alcohols usually have a degree of saponification of about 70 to 90%.

The modified polyvinyl alcohols include carboxyl group-modified polyvinyl alcohols, acetoacetyl group-modified polyvinyl alcohols, sulfonic acid-modified polyvinyl alcohols, cation-modified polyvinyl alcohols, formal-modified polyvinyl alcohols, urethane-modified polyvinyl alcohols, and cyanoethyl-modified polyvinyl alcohols.

The front-side intermediate layer is preferably formed in an amount of 0.01 to 0.5 g/m$^2$, more preferably 0.03 to 0.3 g/m$^2$, still more preferably 0.05 to 0.1 g/m$^2$.

If the front-side intermediate layer is formed in an amount less than 0.01 g/m$^2$, the adhesion-enhancing effect of the resultant front-side intermediate layer for between the front polyolefin laminate layer of the substrate sheet and the ink receiving layer may be insufficient. Also, if the amount is more than 0.5 g/m$^2$, the adhesion-enhancing effect of the portions of the resultant front-side intermediate layer, in which portions no ink is absorbed or a relatively small amount of the ink is absorbed, to the ink receiving layer may be insufficient.

The front-side intermediate layer can be coated by the same method as that for the ink receiving layer.

The front-side intermediate layer may be directly on the front surface of the substrate sheet. Preferably, before the coating, the back surface of the substrate sheet is surface-activated by a corona discharge treatment or a flame treatment to enhance the adhesive property of the substrate sheet surface, and then the front side intermediate layer is formed on the activated surface of the substrate sheet.

The ink jet recording sheet of the present invention can be formed by a method in which a front polyolefin laminate layer is coated on a base paper sheet, successively the front-side intermediate layer is coated on the front polyolefin laminate layer, the resultant semi-product sheet is wound up, and then, in a separate procedure, the wound sheet is unwound and an ink receiving layer is coated on the front-side intermediate layer. Alternatively, the polyolefin resin coated substrate sheet is wound and, in a separate procedure, the wound sheet is unwound, and coated with the front-side intermediate layer and in further separate procedure, an ink receiving layer is coated on the front-side intermediate layer, or the intermediate layer and the ink receiving layer are simultaneously coated by a co-coating method.

Further, in the embodiment of the ink jet recording sheet of the present invention, by controlling the ink absorption capacity of the front-side intermediate layer to a level lower than the lower limit value of the ink absorption capacity of the ink receiving layer, the effect of the present invention can be attained highest.

The ink absorption capacities of the front-side intermediate layer and the ink receiving layer can be adjusted to a desired level by selecting the type of the polymeric materials contained, as a principal component, in the layers and having an ink absorbing property for the ink for the ink jet recording, by mixing the higher ink absorbing polymer with a lower ink absorbing polymer, by controlling the mixing ratio of the above-mentioned polymers, and/or by adding an ink-absorbing pigment in a small amount to the ink absorbing polymeric material.

In the ink jet recording sheet of the present invention comprising the polyolefin resin-coated substrate sheet, the front-side intermediate layer and the ink receiving layer, the reasons for an improved adhesion not only before printing but also after printed, are not fully clear. However, the reasons are assumed to be as follows.

The improvement only in the adhesion between the polyolefin resin-coated substrate sheet and the ink receiving layer can be attained by forming the front-side intermediate layer from a material having a good affinity to both the front polyolefin laminate layer of the substrate sheet and the ink receiving layer. In this case, however, when the ink for the ink jet recording is jetted toward the ink receiving layer and penetrates into the ink receiving layer and the front-side intermediate layer, both the ink receiving layer and the front-side intermediate layer absorb the penetrated ink and this adhesion between the ink receiving layer and the front-side intermediate layer is degrated and thus when a small external physical force is applied to the ink-printed recording sheet, the ink receiving layer locally slips on the substrate sheet to deteriorate the appearance of the printed sheet.

Further, since the ink for the ink jet recording contains a higher alcohol which has a high boiling temperature and thus a poor vaporizing property, when the higher alcohol-containing ink penetrates into the ink receiving layer and the front-side intermediate layer, the higher alcohol is retained in the layers over a long period of time without vaporizing. The above-mentioned phenomenon is enhanced by using the polymeric material having a high affinity to the ink for the ink jet recording and high ink-absorbing property.

When the specific front-side intermediate layer is arranged in the ink jet recording sheet of the present invention, the problem that the ink jet recording ink is accumulated in a large amount, in the boundary between the polyolefin resin coated substrate sheet and the ink receiving layer, can be solved, and thus both before printing and after printed, the adhesion between the ink receiving layer and the polyolefin resin-coated substrate sheet through the front-side intermediate layer can be maintained at a high level. The gelatin, polyvinyl alcohol and modified polyvinyl alcohol contained in the front-side intermediate layer has a relatively low ink absorption capacity for the ink jet recording ink, and thus the phenomenon that the distribution of the printed ink is concentrated in the front-side intermediate layer does not occur and thus the close adhesion between the polyolefin resin-coated substrate sheet and the ink receiving layer through the front-side intermediate layer can be maintained.

Also, it is further assumed that the effect of the present invention is enhanced by controlling the ink absorption capacities of the front-side intermediate layer and the ink receiving layer to specific levels, and by specifically regulating the compositions of the front-side intermediate layer laminated on the polyolefin resin-coated substrate sheet and of the ink receiving layer.

In the ink recording sheet of the present invention, the ink receiving layer comprising hydroxypropylmethylcellulose and/or polyvinyl pyrrolidone exhibits not only a high ink absorption capacity but also an enhanced gloss and ink drying rate and a high clarity of ink images received thereon.

The front-side intermediate layer preferably has an ink absorption capacity of 0.1 ml/g or more but less than 1.5 ml/g. When the ink absorption capacity is less than 0.1 ml/g, the effect of the resultant front-side intermediate layer on enhancing the adhesion between the polyolefin resin-coated substrate sheet and the ink receiving layer may be unsatisfactory. Also, when the ink absorption capacity is 1.5 ml/g or more, and the ink is absorbed in a relatively large amount, the adhesion-enhancing effect of the front-side intermediate layer may be insufficient.

The ink absorption capacity of the ink receiving layer is preferably specified as 1.5 ml/g or more but less than 10 ml/g. When the ink absorption capacity of the ink receiving layer is less than 1.5 ml/g, the resultant ink receiving layer may be unsatisfactory in the ink absorbing property and thus the ink images recorded thereon may be blotted, to deteriorate the clarity of the recorded ink images. When the ink absorption capacity is 10 ml/g or more, the amount of the ink kept in the surface portion of the ink receiving layer may be decreased and thus the color density of the ink images may be decreased.

The ink for the ink jet recording contains an organic solvent component for the coloring component. The solvent component contains at least one member selected from, for example, trimethylolpropane (boiling temperature (b.p.): 58° C.), isopropylenealcohol (IPA, b.p.: 82° C., 1,2-hexanediol (b.p.: 118° C.), ethylene glycol (EG, b.p.: 197° C.), diethylene glycol (DEG, b.p.: 244° C.), tetraethylene glycerol (TEG, b.p.: 287° C.), polyethylene glycol #200, polythylene glycol #400, triethylene glycol butylether (b.p.: 278° C.), glycol (b.p.: 290° C.), diol alkylether, and N-methyl-2-pyrrolidone (b.p.: 245° C.).

The ink jet recording sheet of the present invention preferably exhibit an ink drying rate of 50 minutes or less. Namely, when an ink jet recording ink is applied to the ink jet recording sheet, the applied ink is preferably completely dried within 50 minutes or less. When the ink drying rate is more than 50 minutes, the necessary drying time for the printed ink images is too long and, after printing, when a plurality of printed sheets each having a printed surface facing upperward are superposed one each other, the ink applied on an upper surface of a printed sheet may be transferred to a back surface of another printed sheet superposed on the printed sheet. Thus, the printed sheets must be dried over a long time without being superposed on each other.

This embodiment of the ink jet recording sheet of the present invention having the specific front-side intermediate layer may further have a backcoat layer arranged on a back surface of the polyolefin resin-coated substrate sheet.

The backcoat layer is the same as mentioned above.

Also, the backcoat layer may be formed on a back polyolefin laminate layer of the substrate sheet. In this case, a back-side intermediate layer may be arranged between the back polyolefin laminate layer and the backcoat layer in the same manner as mentioned above.

EXAMPLES

The present invention will be further explained by the following examples which are not intended to limit the scope of the present invention in any way.

Examples I-1 to I-5

In each of Examples I-1 to I-5, the following materials were employed and the following procedures were carried out.

(1) Preparation of Base Paper Sheet

A mixed pulp of 20 parts by dry weight of softwood bleached kraft pulp (NBKP) with 80 parts by dry weight of a hardwood bleached kraft pulp (LBKP) was beaten in a double disk refiner to a Canadian standard freeness of 280 ml. Then mixed pulp was further mixed with the paper-forming additives in the composition shown below, while being fully stirred to prepare a pulp slurry having a consistency of 0.5 by dry weight.

| Pulp composition | Part by dry weight |
|---|---|
| Mixed pulp (NBKP + LBKP) | 100 |
| Alkylketene dimer | 0.4 |
| Cationic starch | 2.0 |
| Cationic polyacrylamide resin | 0.1 |
| Polyamidopolyamine-epichlorohydrin resin | 0.7 |

The pH value of the pulp slurry was adjusted to 7.5 by adding an aqueous sodium hydroxide solution to the slurry.

The aqueous pulp slurry having the above-mentioned composition was subjected to a paper-forming procedure using a fourdrivier paper machine, and the resultant wetted paper sheet was passed through a dryer, a size-press, and a machine calender, to provide a paper sheet having a basis weight of 180 g/m$^2$, a density of 1.0 g/cm$^3$, and a water content of 7.5% by weight.

In the size-press, the size-pressing liquid contained a composition consisting of 2 parts by dry weight of carboxyl group-modified polyvinyl alcohol and 1 part by weight of sodium chloride and had a solid concentration of 5% by weight. The size-pressing liquid was coated on two surfaces of the dried paper sheet at a coating liquid weight of 25 g/m$^2$ corresponding to a coating dry weight of 1.25 g/m$^2$.

(2) Lamination of Front and Back Polyolefin Laminate Layers

A corona discharge treatment was applied to the front (felt) and back (wire) surfaces of the base paper sheet. A polyolefin resin composition (I-1) having a composition consisting of the component materials shown below and disperse-mixed with each other by using a Banbury mixer was laminated in a coating amount of 25 g/m$^2$ on the corona discharge-treated (wire) back surface of the base paper sheet by using a melt-extruder having a T die at a melting temperature of 280° C.

Then a polyolefin resin composition (I-2) having a composition consisting of the component materials shown below and disperse-mixed with each other by using a Banbury mixer was laminated in a coating amount of 30 g/m$^2$ on the corona discharge-treated front (felt) surface of the base paper sheet by using a melt-extruder having a T die at a melting temperature of 280° C., to provide a substrate sheet. In this laminating procedure, the front polyolefin laminate layer was brought into contact with a peripheral surface of a cooling roll made from a steel material which was plated with chromium and finely roughened by a sand blast treatment and had a center-line mean roughness (Ra) shown in Table 1. The roughness (Ra) of the cooling roll peripheral surface was adjusted to a desired value by controlling the type and size of the blasting sand particles, the blasting conditions and the blasting time.

| Component | Part by dry weight |
|---|---|
| Polyolefin resin composition (I-1) | |
| High density polyethylene resin (density: 0.945, melt index: 20 g/10 min.) | 65 |
| Low density polyethylene resin (density: 0.914, melt index: 4 g/10 min.) | 35 |

-continued

| Component | Part by dry weight |
|---|---|
| Polyolefin resin composition (I-2) | |
| Liner low density polyethylene resin (density: 0.926, melt index: 20 g/10 min.) | 35 |
| Low density polyethylene resin (density: 0.919, melt index: 2 g/10 min.) | 50 |
| Anatase titanium dioxide (trademark: A-220, made by ISHIHARA SANGYO K.K.) | 10 |
| Zinc stearate | 0.1 |
| Antioxidant (trademark: IRGANOX 1010, made by CIBA-GEIGY) | 0.03 |
| Ultra marine blue (trademark: BLUISH ULTRAMARINE NO. 2000, made by DAIICHI KASEI K.K.) | 0.09 |
| Fluorescent brightening agent (trademark: UVITEX OB, made by CIBA-GEIGY) | 0.3 |

(3) Formation of Backcoat Layer

The back polyolefin laminate layer surface was surface-activated by a corona discharge treatment and then was coated with a backcoat layer having the composition (I-1) shown below. The resultant backcoat layer was present in a dry weight of 10 g/m$^2$.

| Component | Part by dry weight |
|---|---|
| Backcoat composition (I-1) | |
| Carboxymethylcellulose (trademark: CELLOGEN 7A, made by DAIICHI KOGYOSEIYAKU K.K.) | 95 |
| Polyester resin dispersion (trademark: PESRESIN A-513E, made by TAKAMATSU YUSHI K.K.) | 5 |
| Surfactant (trademark: MEGAFAC F116, made by DAINIHON INKU KAGAKUKOGYO K.K.) | 0.05 |
| Silica (trademark: MIZUKASIL P526, made by MIZUSAWA KAGAKUKOGYO K.K.) | 5 |

(4) Formation of Ink Receiving Layer

The front polyolefin laminate layer surface of the substrate sheet was surface-activated by a corona discharge treatment and then coated with a coating liquid having the composition (I-1) shown below by using a bar coater to form a front-side intermediate layer having a dry weight of 0.1 g/m$^2$. Then, in each of Examples I-1 to I-3, the front-side intermediate layer surface was coated with an ink receiving layer having the composition (1) shown below by using a die coater to form an ink receiving layer having a dry weight of 15 g/m$^2$.

| Component | Part by dry weight |
|---|---|
| Composition (I-1) for front-side intermediate layer | |
| Gelatin (Acid treated cowbone gelatin, made by MIYAGI KAGAKU K.K.) | 100 |
| Surfactant (trademark: EMAL E 27C, made by KAO K.K.) | 0.05 |

-continued

| Component | Part by dry weight |
|---|---|
| Composition (I-1) for ink receiving layer | |
| Hydroxypropylmethylcellulose (trademark: METHOLOSE 65 SH-50, made by SHINETSU KAGAKU KOGYO K.K.) | 75 |
| Polyvinyl pyrrolidone (trademark: RUBISCOL K-17, made by BASF) | 20 |
| Cationic resin (allylamine-diallylamine chloride, trademark: PAA-D11-HCL, made by NITTO BOSEKI K.K.) | 5 |
| Anti-blocking agent (Particulate starch, trademark: ACE A, made by OJI CORNSTARCH K.K.) | 0.2 |

In each of Examples I-4 and I-5, after the front polyolefin laminate layer surface of the substrate sheet was surface-activated by the corona discharge treatment, the surface-activated surface of the front polyolefin laminate layer was coated with the composition (I-2) for a ink receiving layer as shown below by using a die coater, to form an ink receiving layer having a dry weight of 25 g/m$^2$.

| Component | Part by dry weight |
|---|---|
| Composition (I-2) for ink receiving layer | |
| Polyvinyl pyrrolidone (trademark: LUVISKOL K-90, made by BASF) | 95 |
| Cationic resin (allylamine-diallylamine chloride, trademark: PAA-D11-HCL, made by NITTO BOSEKI K.K.) | 5 |
| Anti-blocking agent (Particulate silica, trademark: P-78F, made by MIZUSAWA KAGAKU K.K.) | 0.2 |

Comparative Example I-1 and I-2

In Comparative Example I-1, a paper sheet for the base paper sheet and the substrate sheet comprising the base paper sheet and the front and back polyolefin laminate layers formed on the front and back surfaces of the base paper sheet were prepared by the same procedures as in Example I-1, except that in the formation of the front polyolefin laminate layer, the surface-roughened cooling roll was replaced by a cooling roll having a mirror-finished surface.

The backcoat layer was coated in the same manner as in Example I-1, the corona discharge treatment and the formation of the backcoat layer were carried out in the same manner is in Example I-1. Further, the ink receiving layer was coated by the same procedure as in Example I-1.

In Comparative Example I-2, a paper sheet for the base paper sheet and the substrate sheet comprising the base paper sheet and the front and back polyolefin laminate layers formed on the front and back surfaces of the base paper sheet were prepared by the same procedures as in Example I-1 except that, in the formation of the front polyolefin laminate layer, the surface-roughened cooling roll was replaced by a cooling roll having a mirror-finished surface.

The backcoat layer was coated in the same manner as in Example I-1, the corona discharge treatment was carried out in the same manner is in Example I-1. No front intermediate layer was coated. Further, the ink receiving layer was coated by the same procedure as in Example I-1.

Comparative Example I-3

A substrate sheet having front and back polyolefin laminate layers was produced by the same procedures as in Example I-1, except that in the formation of the front polyolefin laminate layer, the cooling roll was replaced by an other cooling roll having a peripheral surface thereof having a center-line mean roughness (Ra) larger than that in Example I-1.

The back surface and the ink receiving layer were formed by the same procedures as in Example I-1, to produce an ink jet recording sheet.

Comparative Example I-4

A paper sheet for the substrate sheet was prepared by the same procedures as in Example I-1. The paper sheet was employed as a substrate sheet. No front and back polyolefin laminate layers were formed on the paper sheet.

In accordance with the same procedures as in Example I-1, the backcoat layer was coated on the back surface of the paper sheet and the ink receiving layer was coated on the front surface of the paper sheet, to produce an ink jet recording sheet.

Tests

In each of Examples I-1 to I-5 and Comparative Examples I-1 to I-4, the following tests were carried out.

(1) Center-line Mean Roughness (Ra) of Front Polyolefin Laminate Layer Surface

A center-line mean roughness (Ra) of the front polyolefin laminate layer was measured by using a surface roughness tester in accordance with Japanese Industrial Standard (JIS) B 0601-1982.

(2) Adhesion Between Ink Receiving Layer and Front Polyolefin Laminate Layer

In a portion of an ink receiving layer of an ink jet recording sheet, fine straight linear cuts were formed at intervals of 3 mm in parallel to each other, by using a razor and other fine straight linear cuts intersecting at right angles with the above-mentioned fine cuts, were formed in parallel to each other with intervals of 3 mm. An adhesive tape made by OJI KAKO K.K. was attached to the cut portion of the ink receiving layer and then peeled off at a peeling angle of 180 degrees from the ink receiving layer surface. The adhesion of the ink receiving layer to the front polyolefin laminate layer was evaluated in the following three classes.

| Class | Adhesion |
|---|---|
| 3 | No portion of the ink receiving layer was peeled off front polyolefin laminate layer. |
| 2 | Only cut portions of the ink receiving layer were peeled off from the polyolefin laminate layer. |
| 1 | The cut portions and non-cut portions of the ink receiving layer were peeled off from the front polyolefin laminate layer. |

(3) 75° Specular Glossiness

The glossiness was measured in accordance with Japanese Industrial Standard (JIS) P 8142-1993.

(4) Quality of Recorded Ink Images

An ink jet recording sheet was subjected to a printing test by an ink jet printer (trademark: NOVAJET PRO, made by ENCAD, using GO inks) with each of black, cyan, magenta, and yellow-coloring inks to form mixed colored images of the above-mentioned inks. With respect to the printed ink images, the uniformity of the images was evaluated by naked eye observation into the following three classes.

| Class | Uniforminty |
|---|---|
| 3 | No unevenness in color density and no cracking and damage are found in the printed ink images. |
| 2 | Slight unevenness in color density, small cracks and damage are found in the printed ink images. |
| 1 | Significant unevenness in color density and clear cracks and damage are found in the printed ink images. |

(5) Ink Drying Rate

A plurality of ink jet recording sheets were printed with an ink by using an ink jet printer. The printed surfaces of the recording sheets were superposed by woodfree paper sheets at fixed time intervals under pressure, to check whether or not the printed ink images are transferred to the superposed woodfree paper sheet. The ink drying rate of the recording sheet was evaluated into the allowing three classes.

| Class | Ink drying rate |
|---|---|
| 3 | Ten minutes after printed, no transfer of ink is found. |
| 2 | Ten minutes or more but not more than 30 minutes after printed, no transfer of ink is found. |
| 1 | Thirty minutes or more after printed, no transfer of ink is found. |

The test results are shown in Table 1.

TABLE 1

| | Example No. | | | | | | | | | |
|---|---|---|---|---|---|---|---|---|---|---|
| | Example No. | | | | | Comparative Example No. | | | | |
| Item | I-1 | I-2 | I-3 | I-4 | I-5 | I-1 | I-2 | I-3 | I-4 | Note |
| Center-line mean roughness (Ra) of front polyolefin laminate layer | 0.1 μm | 0.2 μm | 0.5 μm | 0.2 μm | 8 μm | 0.05 μm | 0.05 μm | 15 μm | 25 μm | JIS-B0601 |

TABLE 1-continued

| | Example No. | | | | | | | | | |
|---|---|---|---|---|---|---|---|---|---|---|
| | Example No. | | | | | Comparative Example No. | | | | |
| Item | I-1 | I-2 | I-3 | I-4 | I-5 | I-1 | I-2 | I-3 | I-4 | Note |
| Composition No. of ink receiving layer | (I-1) | (I-1) | (I-1) | (I-2) | (I-2) | (I-1) | (I-1) | (I-1) | (I-1) | |
| Corona discharge treatment for front polyolefin laminate layer | Applied | Applied | Applied | Applied | Applied | Applied | Applied | Applied | None | |
| Front-side intermediate layer | Coated | Coated | Coated | None | Coated | Coated | None | Coated | None | |
| Adhesion between ink receiving layer and front polyolefin laminate layer | 3 | 3 | 3 | 3 | 3 | 2 | 1 | 3 | 3 | |
| 75° specular glossiness | 92 | 90 | 60 | 90 | 40 | 93 | 93 | 20 | 15 | JIS-P8142 |
| Image quality | 3 | 3 | 3 | 2 | 2 | 3 | 3 | 3 | 3 | |
| Ink drying rate | 3 | 3 | 3 | 2 | 2 | 3 | 3 | 3 | 3 | |

Table 1 clearly shows that the ink jet recording sheets of Examples 1 to 5 in accordance with the present invention exhibited an excellent adhesion between the ink receiving layer and the front polyolefin laminate layer, a satisfactory 75° specular glossiness, a high quality of ink images and a high ink drying rate.

Compared with these, the ink jet recording sheets of Comparative Example I-1 in which the cooling roll for the front polyolefin laminate layer had a mirror-finished peripheral surface, exhibited a very high 75° specular glossiness, but the adhesion between the ink receiving layer and the front polyolefin laminate layer was unsatisfactory; the ink jet recording sheet of Comparative Example I-2, in which the mirror-finished cooling roll was used for the front polyolefin laminate layer and no front-side intermediate layer was formed, the adhesion between the ink receiving layer and the front polyolefin laminate layer was lower than that in Comparative Example I-1. In Comparative Example I-3 in which the front polyolefin laminate layer surface had a center-line mean roughness (Ra) of 15 $\mu$m which falls outside of the scope of the present invention, the resultant ink receiving layer exhibited a low 75° specular glossiness. In Comparative Example I-4, in which no polyolefin laminate layer was formed on the base paper sheet, the resultant ink receiving layer exhibited very low 75° specular gloss.

In Examples 1 to 5, it was confirmed that the ink jet recording sheets of the present invention exhibited a satisfactory 75° specular glossiness, a high quality of the recorded ink images, a high ink drying property, and a high adhesion between the ink receiving layer and the front polyolefin laminate layer of the substrate sheet.

Examples II-1 to II-3

In each of Examples II-1 to II-3, the following materials were employed and the following procedures were carried out.

(1) Preparation of Base Paper Sheet

A mixed pulp consisting of 20 parts by dry weight of softwood bleached kraft pulp (NBKP) having a Canadian Standard freeness of 250 ml with 80 parts by dry weight of a hardwood bleached kraft pulp (LBKP) having an Canadian standard freeness of 280 ml was suspended in water to provide a pulp slurry having a consistency of 0.5% by dry weight. The pulp slurry was mixed with additives and fully stirred to prepare a pulp composition slurry having the following composition.

| Pulp composition | Part by dry weight |
|---|---|
| Mixed pulp (NBKP + LBKP) | 100 |
| Cationic starch | 2.0 |
| Alkylketene dimer | 0.4 |
| Cationic polyacrylamide resin | 0.1 |
| Polyamidopolyamine-epichlorohydrin resin | 0.7 |

The pH value of the pulp slurry was adjusted to 7.5 by adding an aqueous sodium hydroxide solution to the slurry.

The aqueous pulp slurry having the above-mentioned composition was subjected to a paper-forming procedure using a fourdrivier paper machine, and the resultant wetted paper sheet was passed through a dryer, a size-press, and a machine calender, to provide a paper sheet having a basis weight of 180 g/m$^2$, a density of 1.0 g/cm$^3$, and a water content of 7.5% by weight.

In the size-press, the size-pressing liquid contained a composition consisting of 2 parts by dry weight of carboxyl group-modified polyvinyl alcohol and 1 part by dry weight of sodium chloride and had a solid concentration of 5% by weight. The size-pressing liquid was coated on two surfaces of the dried paper sheet at a total coating liquid weight of 25 g/m$^2$.

(2) Lamination of Front and Back Polyolefin Laminate Layers

A corona discharge treatment was applied to the front (felt) and back (wire) surfaces of the base paper sheet. A polyolefin resin composition (II-1) having a composition consisting of the component materials shown below and disperse-mixed with each other by using a Banbury mixer was laminated in a coating amount of 30 g/m$^2$ on the corona discharge-treated (wire) back surface (on which a backcoat layer will be formed) of the base paper sheet by using a melt-extruder having a T die at a melting temperature of 280° C.

Then a polyolefin resin composition (II-2) having a composition consisting of the component materials shown below and disperse-mixed with each other by using a Banbury mixer was laminated in a coating amount of 30 g/m$^2$ on the corona discharge-treated front (felt) surface (on which an ink receiving layer will be formed) of the base paper sheet by using a melt-extruder having a T die at a melting temperature of 280° C., to provide a substrate sheet. In this laminating procedure, the front polyolefin laminate layer was brought into contact with a peripheral surface of a cooling roll made from a steel material, plated with chromium and finely roughened by a sandblast treatment.

| Component | Part by dry weight |
|---|---|
| Polyolefin resin composition (II-1) | |
| High density polyethylene resin (density: 0.945, melt index: 20 g/10 min.) | 65 |
| Low density polyethylene resin (density: 0.914, melt index: 4 g/10 min.) | 35 |
| Polyolefin resin composition (II-2) | |
| Liner low density polyethylene resin (density: 0.926, melt index: 20 g/10 min.) | 35 |
| Low density polyethylene resin (density: 0.919, melt index: 2 g/10 min.) | 50 |
| Antase titanium dioxide (trademark: A-220, made by ISHIHARA SANGYO K.K.) | 10 |
| Zinc stearate | 0.1 |
| Antioxidant (trademark: IRGANOX 1010, made by CIBA-GEIGY) | 0.03 |
| Ultramarine blue (trademark: BLUISH ULTRAMARINE NO. 2000, made by DAIICHI CASEI K.K.) | 0.09 |
| Fluorescent brightening agent (trademark: UVITEX OB, made by CIBA-GEIGY) | 0.3 |

(3) Formation of Back-side Intermediate Layer

Before coating a backcoat layer, a surface of the back polyolefin laminate layer of the substrate sheet was surface-activated by a corona discharge treatment and then coated with one of compositions (II-1), (II-2) and (II-3) having the composition shown below and in the amount shown in Table 2, by using a gravure coater, to form a back-side intermediate layer.

| Composition (II-1) for back-side intermediate layer | |
|---|---|
| Gelatin made by cowbone-acid extraction method (trademark: G 0282K, made by NITTA GELATIN K.K.) | 100 parts by dry weight |
| Surfactant (trademark: EMAL E 27C, made by KAO K.K.) | 0.05 parts by dry weight |

| Component | Part by dry weight |
|---|---|
| Composition (II-2) for back-side intermediate layer | |
| Gelatin made by a pigskin-acid extraction method (trademark: G 0283K, made by NITTA GELATIN K.K.) | 100 |
| Surfactant (trademark: EMAL E 27C, made by KAO K.K.) | 0.005 |
| Composition (II-3) for back-side intermediate layer | |
| Gelatin made by cowbone-alkali extraction method (trademark: G 0284K, made by NITTA GELATIN K.K.) | 100 |

-continued

| | |
|---|---|
| Surfactant (trademark: EMAL E 27C, made by KAO K.K.) | 0.005 |
| Amine cross-linking agent (trademark: SUMIRASRESIN M3, made by SUMITOMO KAGAKUKOGYO K. K.) | 0.01 |

(4) Formation of Backcoat Layer

The back-side intermediate layer surface was coated with a backcoat layer having the composition (II-1) shown below. The resultant backcoat layer was present in a dry weight of 20 g/m$^2$.

| Component | Part by dry weight |
|---|---|
| Backcoat composition (II-1) | |
| Carboxymethylcellulose (trademark: CELLOGEN 7A, made by DAIICHI KOGYOSEIYAKU K.K.) | 95 |
| Polyester resin dispersion (trademark: PESRESIN A-513E, made by TAKAMATSU YUSHI K.K.) | 5 |
| Surfactant (trademark: MEGAFAC F116, made by DAINIHON INKU KAGAKUKOGYO K.K.) | 0.05 |

(5) Formation of Ink Receiving Layer

The front polyolefin laminate layer surface of the substrate sheet was surface-activated by a corona discharge treatment and then coated with a coating liquid having the composition (II-1) shown below by using a bar coater to form an ink receiving layer having a dry weight of 20 g/m$^2$.

| Component | Part by dry weight |
|---|---|
| Composition (II-1) for ink receiving layer | |
| Polyvinyl alcohol (trademark: KURARAY POVAL 117) | 95 |
| Ink-fixing agent (trademark: SUMIRASRESIN 1001, made by SUMITOMO KAGAKUKOGYO K.K.) | 3 |
| Waterproof agent (trademark: SUMIRASRESIN M-3, made by SUMITOMO KAGAKUKOGYO K.K.) | 2 |

Examples II-4 and II-5

In each of Examples II-4 and II-5, the following procedures were carried out to produce an ink jet recording sheet.

(1) Preparation of Base Paper Sheet

A base paper sheet was prepared by the same procedure as in Example II-1, except that the base weight of the resultant paper sheet was changed to 105 g/m$^2$.

(2) Formation of Front and Back Polyolefin Laminate Layers

The front and back polyolefin laminate layers were formed by the same procedures as in Example II-1, except that the weights of the laminate layers were changed to 15 g/m$^2$ for the front layer and 15 g/m$^2$ for the back layer.

(3) Formation of Back-side Intermediate Layer

Before coating a backcoat layer, a surface of the back polyolefin laminate layer of the substrate sheet was surface-activated by a corona discharge treatment and then coated with one of composition (II-4) having the composition shown below and in the amount of 0.2 g/m$^2$, by using a gravure coater, to form a back-side intermediate layer.

| Component | Part by dry weight |
|---|---|
| Composition (II-4) for back-side intermediate layer | |
| Polyvinyl alcohol (trademark: KURARAY POVAL 117, made by KURARAY K.K.) | 100 |
| Surfactant (trademark: EMAL E 27C, made by KAO K.K.) | 0.005 |
| EPOXY cross-linking agent (trademark: CR-56, made by DAINIHON INKI KAGAKUKOGYO K.K.) | 0.01 |
| Cross-linking catalyst (trademark: PA-20, made by DAINIHON INKI KAGAKUKOGYO K.K.) | 0.002 |

(4) Formation of Backcoat Layer

In Example II-4, a composition (II-2) for the backcoat layer as shown below was coated in a dry amount of 15 g/m$^2$ on the back-side intermediate layer, and in Example II-5, a composition (II-3) for the backcoat layer as shown below was coated in a dry amount of 15 g/m$^2$ on the back-side intermediate layer.

| Component | Part by dry weight |
|---|---|
| Composition (II-2) for back-side intermediate layer | |
| Hydroxypropylmethylcellulose (trademark: METHOLOSE 60 SH-5, made by SHINETSU KAGAKUKOGYO K.K., degree of methoxy-substitution of 1.8, hydroxypropoxy group-substitution molar number: 0.15) | 100 |
| Ethylene-vinyl acetate copolymer resin (trademark: AQUATEX MC 4400, made by CHUO RIKAKOGYO K.K.) | 10 |
| Surfactant (trademark: NONION MN811, made by NIHON YUSHI K.K.) | 0.1 |
| Silica (trademark: MIZUKASIL P-526, made by MIZUSAWA KAGAKUKOGYO K.K.) | 1 |
| Composition (II-3) for back-side intermediate layer | |
| Polyvinyl alcohol (trademark: POVAL 117, made by KURARAY K.K.) | 100 |
| Surfactant (trademark: MEGAFAC F116, made by DAINIHON INKI KAGAKUKOGYO K.K.) | 0.05 |

(5) Formation of the Ink Receiving Layer

A composition (II-2) for ink receiving layer having the following composition was coated in a dry weight of 15 g/m$^2$ on the back-side intermediate layer.

| Component | Part by dry weight |
|---|---|
| Composition (II-2) for ink receiving layer | |
| Polyvinyl pyrrolidone (trademark: K-90, made by BASF) | 80 |
| Polyvinyl alcohol (trademark: POVAL 117, made by KURARAY) | 20 |
| Ink-fixing agent (trademark: SUMIRASRESIN 1001, made by SUMITOMO KAGAKUKOGYO K.K.) | 10 |

-continued

| Component | Part by dry weight |
|---|---|
| Water-proof agent (trademark: SUMIRASRESIN M-3, made by SUMITOMO KAGAKUKOGYO K.K.) | 5 |

Example II-6

An ink jet recording sheet was produced by the same procedures as in Example II-1, except that the back-side intermediate layer was formed in a dry weight of 0.01 g/m$^2$.

Example II-7

An ink jet recording sheet was produced by the same procedures as in Example II-1, except that the back-side intermediate layer was formed in a dry weight of 0.5 g/m$^2$.

Comparative Example II-1

An ink jet recording sheet was produced by the same procedures as in Example II-1, except that no back-side intermediate layer was formed.

Tests

In each of Examples II-1 to II-7 and Comparative Example II-1, the following tests were carried out.

(1) Center-line Mean Roughness (Ra) of Front Polyolefin Laminate Layer Surface

A center-line mean roughness (Ra) of the front polyolefin laminate layer was measured by using a contact needle tester in accordance with Japanese Industrial Standard (JIS) B 0601-1982.

(2) Adhesion Between Backcoat Layer and Back-side Polyolefin Laminate Layer

In a portion of a backcoat layer of an ink jet recording sheet, a plurality of straight linear cuts were formed at intervals of 5 mm in parallel to each other, by using a razor and a plurality of other straight linear cuts intersecting at right angles with the above-mentioned fine cuts, were formed in parallel to each other with intervals of 5 mm. An adhesive tape (made by OJI KAKO K.K.) having a width of 25 mm was attached to the cut portion of the backcoat layer and then peeled off at a peeling angle of 180 degrees from the backcoat layer surface. The adhesion of the backcoat layer to the back polyolefin laminate layer was evaluated in the following three classes.

| Class | Adhesion |
|---|---|
| 3 | No portion of the backcoat layer was peeled off back polyolefin laminate layer. |
| 2 | Only cut portions of the backcoat layer were peeled off from the back polyolefin laminate layer. |
| 1 | The cut portions and non-cut portions of the backcoat layer were peeled off from the back polyolefin laminate layer. |

(3) Resistance to Curling

An ink jet recording sheet was cut into A-4 size and the cut sheet was placed on a flat horizontal surface of a test desk and was subjected to a moisture conditioning for a time period of 5 hours under one of the following condition.

(1) Room temperature room humidity conditioning 20° C., 60% RH (2) Low temperature low humidity conditioning 10° C., 30% RH (3) High temperature high humidity conditioning 30° C., 80% RH After the humidity conditioning, the heights of four upward curled corners of the sheet were measured. The curling height was represented by an average value of the measured data.

When the recording sheet was placed on the desk in such a manner that the back surface of the sheet faces the desk surface, and the corners of the sheet curl upward, this curl is referred to as a top curl, and when the corners of the sheet curl downward, this curl is referred to as a back curl.

The ink jet recording sheet must exhibit no curling or back curling under all of the above-mentioned test conditions. Namely, the curl height is preferably in the range of from 0 to −50 mm. The minus sign means that the curl is a back curl. More preferably, if the curl height is in the range of 0 to −10 mm, the recording sheet can pass through the printer without blocking and the printed sheet can be easily read and handled without difficulty. When the curl height is more than 50 mm in back curl, no difficulty may occur in printing procedure. However, when the printed sheet is subjected to observation, the sheet back-curls, namely, the center portion of the sheet rises upward, and thus it is difficult to make the sheet flat. Otherwise the sheet is curled into a cylinder form. When the curl height is a positive plus value, the corner portions of the sheet rise, and the rised corner portions may come into contact with printing head of the printer so as to disturb the normal working of the printer.

(4) 75° Specular Glossiness

The gloss of the ink jet recorded sheet was measured in accordance with Japanese Industrial Standard (JIS) P 8142-1993.

In the ink jet recording sheets for the full color printing, the 75° specular glossiness thereof is preferably 30% or more, more preferably 65% or more, still more preferably 75% or more, further preferably 90% or more.

The test results are shown in Table 2.

TABLE 2

| | | Example | | | | | | | Comparative |
|---|---|---|---|---|---|---|---|---|---|
| | | 1 | 2 | 3 | 4 | 5 | 6 | 7 | Example 1 |
| Amount of back side intermediate layer | | 0.1 g/m$^2$ | 0.02 g/m$^2$ | 0.3 g/m$^2$ | 0.2 g/m$^2$ | 0.2 g/m$^2$ | 0.01 g/m$^2$ | 0.5 g/m$^2$ | none |
| Adhesion between substrate sheet and backcoat layer | | 3 | 2 | 3 | 3 | 2 | 2 | 3 | 1 |
| Curl height | 20° C. 65% RH | Flat 0 mm | Flat 0 mm | Flat 0 mm | Flat 0 mm | Flat 0 mm | Back curl 0 mm | Flat 0 mm | Back curl −2 mm |
| | 10° C. 30% RH | Back curl −5 mm | Back curl −5 mm | Back curl −5 mm | Back curl −20 mm | Back curl −40 mm | Back curl −5 mm | Back curl −50 mm | Back curl −17 mm |
| | 30° C. 80% RH | Back curl −2 mm | Back curl −2 mm | Back curl −2 mm | Back curl −5 mm | Back curl −15 mm | Back curl −2 mm | Back curl −5 mm | Back curl −2 mm |
| 75° specular glossiness | | 95% | 95% | 95% | 92% | 92% | 95% | 95% | 95% |
| Center-line mean roughness of front polyolefin laminate layer | | 0.2 μm | 0.2 μm | 0.2 μm | 0.3 μm | 0.3 μm | 0.3 μm | 0.3 μm | 0.2 μm |

Table 2 clearly shows that the ink jet recording sheets of Examples II-1 to II-7 prepared in accordance with the present invention, did not form top curl under all of the room temperature room humidity, low temperature low humidity and high temperature high humidity conditions and exhibited a curl height of 0 to −50 mm and a high 75° specular gloss of 90% or more and thus were useful for full color printing. In comparative Example II-1 in which no back-side intermediate layer was formed, the adhesion between the backcoat layer and the substrate sheet was unsatisfactory.

Examples III-1 to III-7 and Comparative Examples III-1 to III-4

In each of Examples III-1 to III-7 and Comparative Examples III-4, an ink jet recording sheet was produced by the following procedures.

(1) Preparation of Base Paper Sheet

A mixed pulp consisting of 20 parts by dry weight of softwood bleached kraft pulp (NBKP) having a Canadian Standard freeness of 250 ml with 80 parts by dry weight of a hardwood bleached kraft pulp (LBKP) having an Canadian standard freeness of 280 ml was suspended in water to provide a pulp slurry having a consistency of 0.5% by dry weight. The pulp slurry was mixed with additives and fully stirred to prepare a pulp composition slurry having the following composition.

| Pulp composition | Part by dry weight |
|---|---|
| Mixed pulp (NBKP:LBKP = 2:8) | 100 |
| Cationic starch (trademark: CATO 302, made by OJI NATIONAL K.K.) | 5.0 |
| Polyacrylamide (trademark: HAIMO KL86, made by HAIMOROK) | 0.1 |
| Alkylketene dimer (trademark: HERCON 601, made by DICK-HERCULES) | 0.5 |
| Polyamidopolyamine-epichlorohydrin resin (KAIMEN 2064, made by DICK-HERCULES) | 0.7 |

The pH value of the pulp slurry was adjusted to 7.5 by adding an aqueous sodium hydroxide solution to the slurry.

The aqueous pulp slurry having the above-mentioned composition was subjected to a paper-forming procedure using a foundrivier paper machine, and the resultant wetted paper sheet was passed through a dryer, a size-press, and a machine calender, to provide a paper sheet having a basis weight of 120 g/m$^2$, a density of 1.0 g/cm$^3$, and a water content of 7.5% by weight.

In the size-press, the size-pressing liquid contained a composition consisting of 2 parts by dry weight of carboxyl group-modified polyvinyl alcohol (trademark: GOSENAL, made by NIHON GOSEIKAGAKU K.K.) and 1 part by weight of sodium chloride and had a solid concentration of 5% by weight. The size-pressing liquid was coated on two surfaces of the dried paper sheet at a total coating liquid weight of 25 g/m$^2$.

(2) Lamination of Front and Back Polyolefin Laminate Layers

A corona discharge treatment was applied to the front (felt) and back (wire) surfaces of the base paper sheet. A polyolefin resin composition (III-1) having a composition consisting of the component materials shown below and disperse-mixed with each other by using a Banbury mixer was laminated in a coating amount of 15 g/m$^2$ on the corona discharge-treated (wire) back surface of the base paper sheet by using a melt-extruder having a T die at a melting temperature of 280° C. to form a back polyolefin laminate layer.

| Component | Part by dry weight |
|---|---|
| Polyolefin resin composition (III-1) | |
| High density polyethylene resin (density: 0.958, melt index: 20 g/10 min.) | 65 |
| Low density polyethylene resin (density: 0.926, melt index: 3.5 g/10 min.) | 35 |

Then, a polyolefin resin composition (III-2) having a composition consisting of the component materials shown below and disperse-mixed with each other by using a Banbury mixer was laminated in a coating amount of 15 g/m$^2$ on the corona discharge-treated front (felt) surface of the base paper sheet by using a melt-extruder having a T die at a melting temperature of 280° C., to provide a substrate sheet. In this laminating procedure, the front polyolefin laminate layer was brought into contact with a peripheral surface of a cooling roll made from a steel material, plated with chromium and finely roughened by a sand blast treatment.

| Component | Part by dry weight |
|---|---|
| Polyolefin resin composition (III-2) | |
| High density polyethylene resin (density: 0.950, melt index: 1 g/10 min.) | 35 |
| Low density polyethylene resin (density: 0.919, melt index: 8.2 g/10 min.) | 50 |
| Anatase titanium dioxide (trademark: A-220, made by ISHIHARA SANGYO K.K.) | 15 |
| Zinc stearate | 0.1 |
| Antioxidant (trademark: IRGANOX 1010, made by CIBA-GEIGY) | 0.03 |
| Ultramarine blue (trademark: BLUISH ULTRAMARINE NO. 2000, made by DAIICHI CASEI K.K.) | 0.09 |
| Fluorescent brightening agent (trademark: UVITEX OB, made by CIBA-GEIGY) | 0.3 |

(3) Formation of Backcoat Layer

The back-side intermediate layer surface was coated with a backcoat layer having the composition (III-1) shown below by a Mayer bar, and dried at a temperate of 110° C. for 10 minutes. The resultant backcoat layer was present in a dry weight of 10 g/m$^2$.

| Component | Part by dry weight |
|---|---|
| Backcoat composition (III-1) | |
| Carboxymethylcellulose sodium salt (trademark: CELLOGEN 7A, made by DAIICHI KOGYOSEIYAKU K.K.) | 100 |
| Polyester resin dispersion (trademark: PESRESIN A-515E, made by TAKAMATSU YUSHI K.K.) | 2 |
| Surfactant (trademark: NONION, made by NIHON YUSHI K.K.) | 0.2 |
| Antiblocking agent (amorphous silica, trademark: MIZUKASIL P76F, made by MIZUSAWA KAGAKUKOGYO K.K.) | 0.5 |

After the backcoat layer was coated on the back surface of the polyolefin resin-coated substrate sheet, the front polyolefin laminate layer surface of the substrate sheet was successively coated with a front-side intermediate layer and an ink jet recording layer. The compositions of the coating liquids for the front-side intermediate layer and the ink receiving layer were as follows. Also, the coating amounts of these layers were as shown in Table 3.

(4) Preparation of Coating Composition for Front-side Intermediate Layer

The following coating compositions (III-1) to (III-6) were prepared.

| Component | Part by dry weight |
|---|---|
| Composition (III-1) for front side intermediate layer | |
| Gelatin (made by a cowbone-acid extraction method, trademark: G 0282K, made by NITTA GELATIN K.K.) | 100 |
| Surfactant (trademark: EMAL E 27C, made by KAO K.K.) | 1 |

An aqueous solution of the composition (III-1) was prepared in a solid content of 10% by weight.

| Component | Part by dry weight |
|---|---|
| Composition (III-2) for front side intermediate layer | |
| Gelatin (made by a pigskin-acid extraction method, trademark: G 0283K, made by NITTA GELATIN K.K.) | 100 |
| Cross-linking agent (melamine compound, made by SUMITOMO KAGAKUKOGYO K.K.) | 5 |
| Surfactant (trademark: EMAL E 27C, made by KAO K.K.) | 1 |

An aqueous solution of the composition (III-1) was prepared in a solid content of 10% by weight.

| Component | Part by dry weight |
|---|---|
| Composition (III-3) for front side intermediate layer | |
| Gelatin (made by a cowbone-acid extraction method, trademark: G 0282K, made by NITTA GELATIN K.K.) | 100 |
| Cross-linking agent (epoxy compound, trademark: DECONAL, made by NAGASE KASEI K.K.) | 3 |
| Surfactant (trademark: EMAL E 27C, made by KAO K.K.) | 1 |

An aqueous solution of the composition (III-1) was prepared in a solid content of 10% by weight.

| Component | Part by dry weight |
|---|---|
| Composition (III-4) for front side intermediate layer | |
| Polyvinyl alcohol (Full saponified, trademark: AH17, made by NIHON GOSEI KAGAKU K.K.) | 100 |
| Surfactant (trademark: EMAL E 27C, made by KAO K.K.) | 1 |

An aqueous solution of the composition (III-1) was prepared in a solid content of 10% by weight.

| Component | Part by dry weight |
|---|---|
| Composition (III-5) for front side intermediate layer | |
| Polyvinyl acetal (trademark: ESREC KW-1, made by SEKISUI KAGAKUGOHYO K.K.) | 100 |
| Surfactant (trademark: EMAL E 27C, made by KAO K.K.) | 1 |

An aqueous solution of the composition (III-1) was prepared in a solid content of 10% by weight.

| Component | Part by dry weight |
|---|---|
| Composition (III-6) for front side intermediate layer | |
| Hydroxypropylmethylcellulose (trademark: METHOLOSE 50SH-05, made by SHINETSU KAGAKUKOGYO K.K.) | 100 |
| Surfactant (trademark: EMAL E 27C, made by KAO K.K.) | 0.005 |

An aqueous solution of the composition (III-1) was prepared in a solid content of 10% by weight.

(5) Preparation of Coating Composition for Ink Receiving Layer

The following coating compositions (III-1) to (III-5) for the ink receiving layer were prepared.

| Component | Part by dry weight |
|---|---|
| Coating composition (III-1) for ink receiving layer | |
| Hydroxypropylmethylcellulose (trademark: METHOLOSE 50SH-15, made by SHINETSU KAGAKU KOGYO K.K.) | 100 |
| Polyvinyl pyrrolidone (trademark: Rubiscol K-60, made by ISP) | 30 |
| Cationic ink-fixing agent (trademark: SUMIRASRESIN 1001, made by SUMITOMO KAGAKUKOGYO K.K.) | 10 |
| Anti-blocking agent (amorphous silica having particle size of about 12 μm, trademark: P78F, made by MIZUSAWA KAGAKUKOGYO K.K.) | 0.5 |
| Surfactant (trademark: EMAL E 27C, made by KAO K.K.) | 0.5 |
| Fluorescent brightening agent (trademark: Whitex BPSH, made by SUMITOMO KAGAKUKOGYO K.K.) | 0.5 |
| Defoaming agent (trademark: DEFOAMER 777, made by SUNNOPCO K.K.) | 0.5 |
| Coating composition (III-2) for ink receiving layer | |
| Hydroxypropylmethylcellulose (trademark: METHOLOSE 65SH-50, made by SHINETSU KAGAKUKOGYO K.K.) | 100 |
| Polyvinyl pyrrolidone (trademark: Rubiscol K-30, made by ISP) | 50 |
| Cationic ink-fixing agent (trademark: E117, made by NIKKA KAGAKUKOGYO K.K.) | 3 |
| Anti-blocking agent (amorphous silica having particle size of about 12 μm, trademark: P78F, made by MIZUSAWA KAGAKUKOGYO K.K.) | 0.5 |
| Surfactant (trademark: EMAL E 27C, made by KAO K.K.) | 0.5 |
| Fluorescent brightening agent (trademark: Whitex BPSH, made by SUMITOMO KAGAKUKOGYO K.K.) | 0.5 |
| Defoaming agent (trademark: DEFOAMER 777, made by SUNNOPCO K.K.) | 0.5 |
| Coating composition (III-3) for ink receiving layer | |
| Hydroxypropylmethylcellulose (trademark: METHOLOSE 60H-15, made by SHINETSU KAGAKU KOGYO K.K.) | 100 |
| Anti-blocking agent (amorphous silica having particle size of about 12 μm, trademark: P78F, made by MIZUSAWA KAGAKUKOGYO K.K.) | 0.5 |
| Surfactant (trademark: EMAL E 27C, made by KAO K.K.) | 0.5 |
| Fluorescent brightening agent (trademark: Whitex BPSH, made by SUMITOMO KAGAKUKOGYO K.K.) | 0.5 |
| Defoaming agent (trademark: DEFOAMER 777, made by SUNNOPCO K.K.) | 0.5 |
| Coating composition (III-4) for ink receiving layer | |
| Polyvinyl acetal resin (trademark: ESLEC KW-1, made by SEKISUI KAGAKU KOGYO K.K.) | 100 |
| Anti-blocking agent (amorphous silica having particle size of about 12 μm, trademark: P78F, made by MIZUSAWA KAGAKUKOGYO K.K.) | 0.2 |
| Coating composition (III-5) for ink receiving layer | |
| Partially saponified polyvinyl alcohol (trademark: KH-20, made by NIHON GOSEI KOGYO K.K.) | 100 |

-continued

| Component | Part by dry weight |
|---|---|
| Anti-blocking agent (amorphous silica having particle size of about 12 μm, trademark: P78F, made by MIZUSAWA KAGAKUKOGYO K.K.) | 0.2 |
| Defoaming agent (trademark: DEFOAMER 777, made by SUNNOPCO K.K.) | 0.5 |

(6) Formation of Front-side Intermediate Layer and Ink Receiving Layer

The front surface of the above-mentioned polyolefin resin-coated substrate sheet was surface-activated by a corona discharge treatment and then coated with one of the above mentioned coating compositions by a Mayer bar and the coated composition layer was dried in an air flow dryer at a temperature of 110° C. for 3 minutes, to form a front side intermediate layer having the dry weight shown in Table 3.

In Comparative Example III-1, no front-side intermediate layer was coated.

Then, one of the coating compositions for the ink receiving layer was coated on the front side intermediate layer by using an applicator and the coated composition layer was dried in an air blow dryer at a temperature of 110° C. for 10 minutes, to form an ink receiving layer in the amount shown in Table 3.

Tests

Each of the ink jet recording sheets of the examples and comparative examples was subjected to the following tests.

(1) Measurement of Ink Absorption Capacity

The ink absorption capacities of the front-side intermediate layers and the ink receiving layers were measured by the above-mentioned measurement method.

(2) Adhesion of Ink Receiving Layer to the Substrate Sheet (2-1) Adhesion before printing In a portion of a non-printed ink receiving layer of an ink jet recording sheet, a plurality of straight linear cuts were formed at intervals of 5 mm in parallel to each other, by using a sharp knife and a plurality of other straight linear cuts intersecting at right angles with the above-mentioned fine cuts, were formed in parallel to each other at intervals of 5 mm. An adhesive tape (made by OJI KAKO K.K.) was firmly adhered to the cut portion of the ink receiving layer while preventing the formation of air bubbles in the interface between the receiving layer and the adhesive tape and then peeled off at a peeling angle of 180 degrees from the ink receiving layer surface. The adhesion of the ink receiving layer to the front polyolefin laminate layer was evaluated by checking whether or not the ink receiving layer and/or the front-side intermediate layer were peeled off, in the following three classes.

| Class | Adhesion |
|---|---|
| 3 | No portion of the ink receiving layer and the front-side intermediate layer were peeled off from the substrate sheet. |
| 2 | The front-side intermediate layer or the ink receiving layer were partially peeled off from the substrate sheet. |
| 1 | The adhesive tape-adhered portions of the ink receiving layer was peeled off from the substrate sheet. |

(2-2) Adhesion after being printed

The ink jet recording sheet was solid printed by using an ink jet recording system color printer (trademark PM 9000C, made by EPSON) with a blue-coloring ink, and 30 minutes after the solid printing, the ink-printed portion of the ink receiving layer was subjected to the same adhesion test as mentioned above and the test results were evaluated in the same manner as mentioned above.

(3) Ink Jet Printing Property

The ink jet recording sheet was printed in various image patterns by using an ink jet recording system color printer (trademark: PM 700C, made by EPSON). The quality of the printed ink images was evaluated by the following tests.

(3-1) Ink Drying Rate

A plurality of ink jet recording sheets were solid printed with an ink by using an ink jet printer with black, cyan, magenta, and yellow-coloring inks to form mixed colored images of the above-mentioned inks. The solid printed surfaces of the recording sheets were superposed with woodfree paper sheets at time intervals of one minute under pressure, to check whether or not the printed ink images are transferred to the superposed woodfree paper sheets. The ink drying rate of the recording sheet was represented by a time period after which no transfer of the ink images to the woodfree paper sheets was detected.

(3-2) Evenness of the printed images

The same printing test as mentioned above was carried out. The resultant black, cyan, magenta, yellow, red, green and blue-colored ink images were observed to check whether or not the printed images are even or uneven in color density. The results were classified to the following three classes

| Class | Evenness |
|---|---|
| 3 | The red, green and blue-colored images are quite even in color density. |
| 2 | The black, cyan, magenta and yellow-colored images are quite even in color density, but the red, green and blue-colored images are uneven in color density. |
| 1 | The black, cyan, magenta and yellow-colored images are uneven in color density, and thus this recording sheet cannot be used in practice. |

(3-3) Clarity of ink images

The ink jet recording sheet was printed in a color photograph test pattern (for example, ISO standard image data, NIHON INDUSTRIAL STANDARD ASSOCIATION) by a ink jet recording system color printer. The clarity of the printed ink images were evaluated as follows.

| Class | Clarity |
|---|---|
| 3 | No blotting of ink in thin lines or contours of the ink images occurs, and the clarity of the images is good, and the recording sheet is practically usable for printing color photographic images. |
| 2 | Slight blotting of ink in thin lines and contours of the ink images occurs, and the recording sheet is practically usable for printing color photographic images. |

-continued

| Class | Clarity |
|---|---|
| 1 | Color blotting of ink in thin lines and contours of ink images occurs and thus the recording sheet is unsuitable for printing photographic images. |

(4) Center-line Mean Roughness (Ra) of Front Polyolefin Laminate Layer Surface

The center-line mean roughness (Ra) of the front polyolefin laminate layer was measured by using a contact needle tester in accordance with Japanese Industrial Standard (JIS) B 0601-1982.

The test results are shown in Table 3.

TABLE 3

| | Example No. | | | | | | | | | | |
|---|---|---|---|---|---|---|---|---|---|---|---|
| | Example No. | | | | | | | Comparative Example No. | | | |
| Item | III-1 | III-2 | III-3 | III-4 | III-5 | III-6 | III-7 | III-1 | III-2 | III-3 | III-4 |
| Composition No. for front-side intermediate layer | III-1 | III-2 | III-3 | III-2 | III-4 | III-4 | III-2 | None | III-3 | III-6 | III-5 |
| Dry weight of front-side intermediate layer (g/m$^2$) | 0.01 | 0.03 | 0.1 | 0.3 | 0.5 | 0.5 | 0.3 | — | 3.0 | 1.0 | 0.5 |
| Ink absorption capacity of front-side intermediate layer (ml/g) | 0.8 | 0.3 | 0.2 | 0.3 | 1.2 | 1.2 | 0.3 | — | 0.2 | 1.5 | 0.5 |
| Composition No. of ink receiving layer | III-1 | III-1 | III-2 | III-2 | III-3 | III-3 | III-5 | III-2 | III-4 | III-3 | III-2 |
| Dry weight of ink receiving layer (g/m$^2$) | 3 | 15 | 20 | 15 | 30 | 50 | 50 | 20 | 20 | 15 | 20 |
| Ink absorption capacity of in receiving layer (ml/g) | 2.0 | 2.0 | 2.5 | 2.5 | 1.5 | 1.5 | 5.0 | 2.5 | 0.5 | 1.5 | 2.5 |
| Adhesion of non-printed ink receiving layer to substrate sheet | 3 | 3 | 3 | 3 | 3 | 3 | 3 | 1 | 1 | 3 | 1 |
| Adhesion of printed ink receiving layer to substrate sheet | 3 | 3 | 3 | 3 | 3 | 3 | 2 | 1 | 1 | 1 | 2 |
| Ink drying rate (min) | 20 | 20 | 20 | 20 | 20 | 15 | 30 | 20 | >60 | 30 | 30 |
| Evenness in color density of ink images | 3 | 3 | 3 | 3 | 3 | 2 | 2 | 3 | 1 | 3 | 2 |
| Clarity of ink images | 3 | 3 | 3 | 3 | 2 | 2 | 2 | 3 | 1 | 3 | 2 |
| Center-line mean roughness front polyolefin laminate layer ($\mu$m) | 0.2 | 0.2 | 0.2 | 0.2 | 0.2 | 0.2 | 0.2 | 0.2 | 0.2 | 0.2 | 0.2 |

Table 3 clearly shows that the ink jet recording sheet of Examples III-1 to III-7 exhibited a high adhesion between the ink receiving layer to the polyolefin resin-laminated substrate sheet and excellent ink jet recording properties (a high ink drying rate, a high evenness in color density and a high clarity of the ink images.)

What is claimed is:

1. An ink jet recording sheet, comprising a substrate comprising a base paper sheet and at least a front polyolefin laminate layer formed by extrusion-laminating a polyolefin resin composition on at least a front surface of the base paper sheet, the surface of the front polyolefin laminate layer being finely roughened and exhibiting a center-line mean roughness (Ra) or 0.1 to 10 $\mu$m, determined in accordance with Japanese Industrial Standard B0601-1982; and an ink receiving layer formed on a surface of the polyolefin laminate layer of the substrate, and comprising a mixture of hydroxypropylmethyl cellulose with polyvinyl pyrrolidone in a mixing weight ratio of 100:10 to 100:150, the surface of the ink receiving layer exhibiting a 75° specular glossiness of 30% or more, determined in accordance with Japanese Industrial Standard P8142-1993, (1) wherein a front-side intermediate layer comprising at least one polymeric material selected from the group consisting of gelatin, polyvinyl alcohol and cation-modified polyvinyl alcohols, is formed between the polyolefin laminate layer of the substrate and the ink receiving layer, and (2) the ink receiving layer formed on the front-side intermediate layer exhibits an ink absorption capacity of 1.5 ml/g or more, but less than 10 ml/g, and the front-side intermediate layer exhibits an ink absorption capacity of 0.1 ml/g or more but less than 1.5 ml/g.

2. The ink jet recording sheet as claimed in claim 1, wherein the finely roughened surface of the polyolefin laminate layer is formed by bringing an extrusion laminated polyolefin resin composition melt layer on the base paper sheet, into contact with a peripheral surface of a cooling roll, to thereby adjust the center-line mean roughness (Ra) of the resultant polyolefin laminate layer to 0.1 to 10 μm, as determined in accordance with Japanese Industrial Standard B 0601-1982.

3. The ink jet recording sheet as claimed in claim 1, further comprising a backcoat layer formed on a back surface side of the substrate on which no ink receiving layer is formed, and a back-side intermediate layer formed between the back surface of the substrate and the backcoat layer to firmly bond the backcoat layer to the substrate therethrough.

4. The ink jet recording sheet as claimed in claim 3, wherein the backcoat layer comprises at least one cellulose compound.

5. The ink jet recording sheet as claimed in claim 4, wherein the cellulose compound for the backcoat layer is selected from the group consisting of cellulose nitrate, cellulose acetate, cellulose acetate isopropionate, cellulose acetate butyrate, methylcellulose, ethylcellulose, hydroxymethylcellulose, hydroxyethylcellulose, carboxymethylcellulose, hydroxypropylcellulose, hydroxypropylmethycellulose, carboxymethylhydroxyethylcellulose, carboxymethylhydroxyethylcellulose salts and carboxymethylcellulose salts.

6. The ink jet recording sheet as claimed in claim 3, wherein the back-side intermediate layer is present in an amount of 0.001 to 1.0 g/m$^2$.

7. The ink jet recording sheet as claimed in claim 3, wherein the back-side intermediate layer comprises an adhesive polymeric material selected from the group comprising hydrophilic polymeric materials and lattices of water-insoluble polymeric materials.

8. The ink jet recording sheet as claimed in claim 1, wherein the ink receiving layer exhibits an ink drying rate, which is represented by a time period between a state at which ink images are ink jet-recorded on a ink jet recording sheet and a stage at which no transfer of the ink in the ink images recorded on the ink jet recording sheet to a wood-free paper sheet superposed on the ink jet recording sheet under pressure is found, of 50 minutes or less.

9. The ink jet recording sheet as claimed in claim 1, wherein the front-side intermediate layer is present in an amount of 0.01 to 0.5 g/m$^2$, and the ink receiving layer formed on the front-side intermediate layer is present in an amount of 3 to 50 g/m$^2$.

10. The ink jet recording sheet as claimed in claim 1, wherein the hydroxypropylmethylcellulose for the ink receiving layer has a degree of substitution, which means, in glucose ring units of cellulose, an average number of hydroxyl groups substituted by methoxy group, of 1.5 or more.

11. The ink jet recording sheet as claimed in claim 10, wherein the hydroxypropylmethylcellulose has a degree of substitution of hydroxyl groups in the glucose ring units of cellulose by methoxy groups of 1.5 to 3.

12. The ink jet recording sheet as claimed in claim 1, wherein the hydroxypropylmethylcellulose has addition-reacted hydroxypropyl groups in an average molar amount of 0.10 to 0.34 moles per mole of the glucose ring units thereof.

13. The ink jet recording sheet as claimed in claim 1, wherein the hydroxypropylmethylcellulose has a weight average molecular weight of 80,000 to 170,000.

14. The ink jet recording sheet as claimed in claim 1, wherein the polyvinyl pyrrolidone is present in an amount of 18 to 82 parts by weight per 100 parts by weight of the hydroxyproplmethylcellulose.

15. The ink jet recording sheet as claimed in claim 1, wherein the polyvinyl pyrrolidone has a weight average molecular weight of 5,000 to 100,000.

* * * * *